US009446530B2

(12) United States Patent
Wong

(10) Patent No.: US 9,446,530 B2
(45) Date of Patent: Sep. 20, 2016

(54) MANDOLIN SLICER

(71) Applicant: King's Flair Development Ltd., Hong Kong (HK)

(72) Inventor: Siu Wah Wong, Hong Kong (HK)

(73) Assignee: KING'S FLAIR DEVELOPMENT LTD., Hong Kong (HK)

( * ) Notice: Subject to any disclaimer, the term of this patent is extended or adjusted under 35 U.S.C. 154(b) by 0 days.

(21) Appl. No.: 14/582,356

(22) Filed: Dec. 24, 2014

(65) Prior Publication Data

US 2015/0246457 A1 Sep. 3, 2015

Related U.S. Application Data

(63) Continuation-in-part of application No. 14/256,099, filed on Apr. 18, 2014, now Pat. No. 9,296,115.

(60) Provisional application No. 61/945,982, filed on Feb. 28, 2014.

(51) Int. Cl.

| | |
|---|---|
| ***B26D 3/28*** | (2006.01) |
| ***B26B 3/03*** | (2006.01) |
| ***B26D 7/26*** | (2006.01) |

(52) U.S. Cl.

CPC ..... *B26D 3/283* (2013.01); *B26B 3/03* (2013.01); *B26D 7/2628* (2013.01); *B26D 2003/287* (2013.01); *B26D 2003/288* (2013.01)

(58) Field of Classification Search

CPC ..... B26B 3/03; B26B 29/063; B26D 3/283; B26D 2003/285; B26D 2003/287; B26D 7/2628; B26D 2003/288

See application file for complete search history.

(56) References Cited

U.S. PATENT DOCUMENTS

| | | | | |
|---|---|---|---|---|
| 8,151,678 | B2 * | 4/2012 | Mah | B26D 3/283 83/397 |
| 8,813,640 | B2 * | 8/2014 | Wong | B26D 3/283 83/856 |
| 8,839,702 | B2 * | 9/2014 | Bagley | B26D 3/283 83/425.3 |
| 8,893,602 | B2 * | 11/2014 | Fung | A47J 43/25 83/727 |
| 9,038,517 | B2 * | 5/2015 | Lucas | B26D 3/283 83/437.1 |
| 9,296,115 | B2 * | 3/2016 | Wong | B26B 29/063 |
| 2004/0231482 | A1 * | 11/2004 | Boilen | B26D 3/283 83/425.3 |
| 2006/0075872 | A1 * | 4/2006 | Wangler | B26D 3/283 83/856 |
| 2006/0283299 | A1 * | 12/2006 | Mellen | B26D 3/283 83/401 |
| 2008/0098866 | A1 * | 5/2008 | DiPietro | B26D 3/283 83/440.2 |
| 2009/0255391 | A1 * | 10/2009 | Hood | B26D 3/283 83/648 |
| 2015/0246457 | A1 * | 9/2015 | Wong | B26B 3/03 30/279.6 |

FOREIGN PATENT DOCUMENTS

WO WO 2012/136742 A1 * 10/2012

* cited by examiner

*Primary Examiner* — Hwei C Payer
(74) *Attorney, Agent, or Firm* — Nyemaster Goode P.C.

(57) ABSTRACT

The present invention provides a mandolin slicer adjustable for slicing item in variable thicknesses and variable shapes, wherein the adjustment is enabled by a ballpoint pen ratchet mechanism provided on the mandolin slicer. The mandolin slicer of the present invention further comprises an indicating mechanism to clearly indicate the selected thickness and shape of the sliced item.

17 Claims, 24 Drawing Sheets

MANDOLIN SLICER

TECHNICAL FIELD OF THE INVENTION

This invention relates generally to the field of kitchen utensils, and more particularly relates to a mandolin slicer that is adjustable to slice item in variable thicknesses.

BACKGROUND OF THE INVENTION

Mandolin slicers are used for slicing food items into slices. A typical mandolin slicer comprises a handle, a frame, a slicing plate fixed within the frame and a guiding plate pivotally held within the frame, one edge of the slicing plate being configured as a sharp slicing blade. The slicing blade of the slicing plate is positioned with a gap formed between the slicing blade and the end of the guiding plate. The sliced items pass through the gap between the slicing blade and the end of the guiding plate. Therefore, the width of the gap determines the thickness of the sliced items. A cutting plate can additionally be provided with variable cutting teeth mounted thereon to to achieve variable slicing patterns such as strips.

A lot of conventional mandolin slicers are configured to adjust vertically the gap between the slicing blade and the end of the handle by, for example, an adjustment knob to provide variable slice thicknesses of the food item to be sliced. Such mandolin slicers usually require the user to rotate the adjustment knob arranged on the handle to adjust the slice thickness, which generally requires using both hands to do it. Another drawback of the adjustable mandolin slicers is that no indication of the width of the variable gap is provided, making it difficult for the user to know the slice thickness before the item is sliced.

Therefore, there is a need for a mandolin slicer which can be easily and conveniently adjusted to slice items into slices of variable thicknesses and variable slicing patterns, and which provides a clear indication of the slice thickness and shape to be selected.

SUMMARY OF THE INVENTION

The present invention has a principle object of providing a mandolin slicer which is adjustable to provide variable slice thicknesses of the item to be sliced, and optionally provide variable slicing patterns such as strips. More particularly, the present invention aims to provide a mandolin slicer which can be conveniently adjusted for slicing item into slices of different thicknesses or different shapes by for example pressing a ballpoint pen ratchet mechanism provided on the mandolin slicer. Furthermore, the present invention aims to provide a mandolin slicer which comprises an indicator mechanism to clearly indicate the selected thickness of the item slices.

These and other objects are satisfied by the present invention, which provides a mandolin slicer comprising:

a handle having a first end and a second end;

a frame extending from the first end of the handle and having two opposite side walls;

a guiding plate having a proximal end pivotally connected to the frame, and a distal end;

a slicing plate held between the two side walls of the frame and configured to comprise a slicing blade, wherein the slicing blade and the distal end of the guiding plate together define a gap as slice thickness for an item to be sliced;

a linkage for movably carrying the guiding plate so that the movement of the linkage enables the guiding plate to pivot around its proximal end, wherein the guiding plate pivots relative to the slicing blade thereby to provide variable slice thickness for the item to be sliced; and an actuator assembly in operative connection with the linkage to move the linkage relative to the guiding plate around the proximal end of the guiding plate.

In one embodiment of the present invention, the linkage may be configured to move to a plurality of carrying positions of the guiding plate for carrying the guiding plate so as to create a plurality of predetermined slice thicknesses.

In one embodiment of the present invention, the mandolin slicer may further comprise a cutting plate arranged under the guiding plate, the cutting plate having a first end portion pivotally connected to the frame, and a second end portion having a plurality of cutting teeth mounted thereon, wherein when the linkage moves to one of designated one or more of the plurality of carrying positions, the cutting plate is permitted to pivot upwardly around its first end portion towards the guiding plate, causing the plurality of cutting teeth to protrude beyond the guiding plate through a plurality of slots formed in the guiding plate in the vicinity of the distal end, such that the item to be sliced is subject to a cutting operation implemented by the cutting teeth in combination with the slicing blade; and when the linkage moves away from the designated carrying position, the cutting plate pivots downwardly to release the cutting teeth from the guiding plate, such that the item to be sliced is subject to a cutting operation implemented by the slicing blade only.

In one embodiment of the present invention, the designated carrying position may be set to immediately follow the carrying position that provides the largest predetermined slice thickness, and said designated carrying position is configured to create the same slice thickness as said carrying position of the largest predetermined slice thickness.

In one embodiment of the present invention, the actuator assembly may be configured as a ballpoint pen ratchet mechanism provided in the handle, and the ballpoint pen ratchet mechanism may be latched in a plurality of latched positions, which are respectively correspondent to the plurality of carrying positions of the linkage.

In one embodiment of the present invention, the ballpoint pen ratchet mechanism may comprise:

a push plunger, and a ratchet connected to a compression spring which is forced to move the ratchet upward, and coupled to the linkage, wherein the push plunger and the ratchet may comprise cooperating cam faces whereby the ratchet tends to rotate when the cam faces of the push plunger are forced against the cam faces of the ratchet, and the rotation of the ratchet results in an axial displacement of the ratchet among the plurality of latched positions, which causes the linkage to move to the plurality of carrying positions.

In one embodiment of the present invention, the ballpoint pen ratchet mechanism may further comprise a sleeve having a plurality of spaced apart axial slots of different lengths formed on an inner wall thereof; and the ratchet may comprise an axial rib which is rotated to alternately engage with the respective axial slots of the sleeve, thereby allowing the ratchet to reach the respective latched positions.

In one embodiment of the present invention, the ballpoint pen ratchet mechanism may comprise a button fixedly connected to the push plunger and extending beyond the second end of the handle.

In one embodiment of the present invention, the linkage may be configured to have a first portion comprising two spaced apart legs which movably carry two opposite sides of the guiding plate, a second portion integrally formed with the first portion, and a third portion having one end rotatably coupled to the second portion and the other end fixed to the ratchet.

In one embodiment of the present invention, a pair of lugs may extend downwardly from the two sides, respectively, of the guiding plate, and a plurality of steps on a bottom surface of each of the lugs may be formed in a direction of the movement of the linkage to provide the plurality of carrying positions where the legs of the linkage carry the guiding plate.

In one embodiment of the present invention, a bump may be formed at an end of each of the two legs of the linkage, and a protrusion may be formed on each of two opposite sides of the cutting plate and positioned to correspond to the designated carrying position, such that the bumps press against the protrusions, causing the cutting plate to pivot upwardly with the cutting teeth moving to protrude beyond the guiding plate through the slots.

Preferably, a pair of springs may be provided each having one end fixed to a respective side of the cutting plate to bias the cutting plate to pivot downwardly, such that the cutting teeth are released from the guiding plate.

In another embodiment of the present invention, the cutting plate may comprise a guiding trough formed beneath one of the protrusions for receiving a leading portion of the respective leg, the guiding trough comprising a first portion having a constant width, and a second portion extending from the first portion and having an incrementally increasing width, wherein the width of the first portion is sized to purposely constrain the cutting plate in place when the leading portion of the leg is received therein until the bumps press against the protrusions where the leading portion of the leg moves to the second portion, and the increasing width of the second portion is sized to release the constraint of the cutting plate and allow the cutting plate to pivot upwardly.

In one embodiment of the present invention, the handle may comprise an indicating window; and a plurality of indicators corresponding to the carrying positions may be arranged on the linkage and configured in such a manner that the indicator corresponding to the respective carrying position moves to be exposed through the indicating window with the movement of the linkage to said carrying position.

In one embodiment of the present invention, an indicator plate may be fixed on the linkage, and the plurality of indicators may be arranged on the indicator plate.

In one embodiment of the present invention, the guiding plate may be pivotally connected to the frame by a pair of hinges arranged on the frame and inserted into a pair of holes formed on two opposite sides, respectively, of the proximal end of the guiding plate.

In one embodiment of the present invention, the cutting plate may be pivotally connected to the frame by a pair of bulges formed on two opposite sides, respectively, of the first end of the cutting plate and inserted into a pair of openings formed on the frame.

Preferably, the handle and the frame are formed integrally.

To have a better understanding of the invention reference is made to the following detailed description of the invention and embodiments thereof in conjunction with the accompanying drawings.

DETAILED DESCRIPTION OF THE INVENTION

While this invention is illustrated and described in preferred embodiments, the mandolin slicer of the present invention may be produced in many different configurations, sizes, forms and materials.

Figure 1:
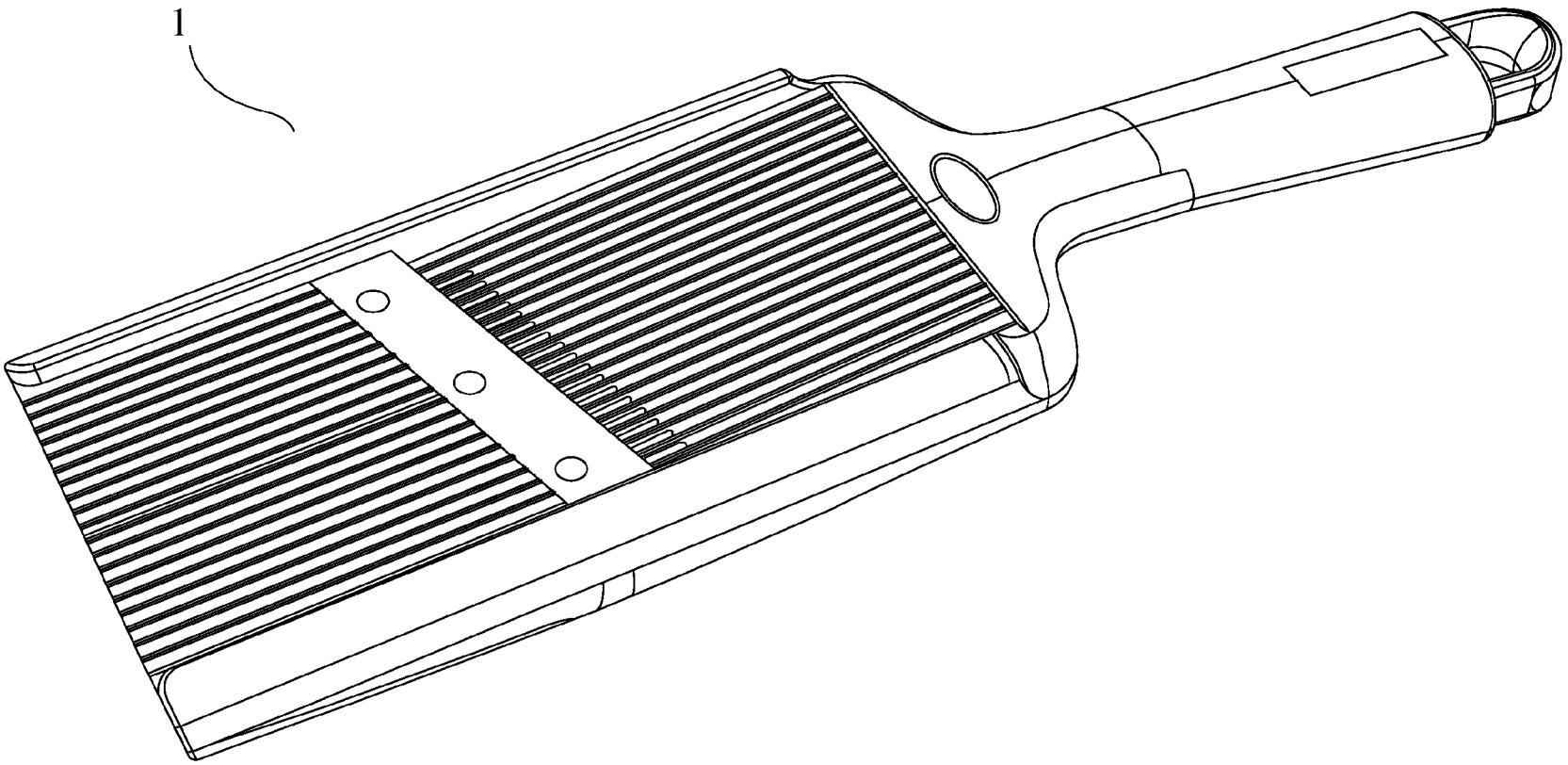
FIG. 1 is a perspective top view of a mandolin slicer according to a first embodiment of the present invention in an assembled state.
Figure 2:
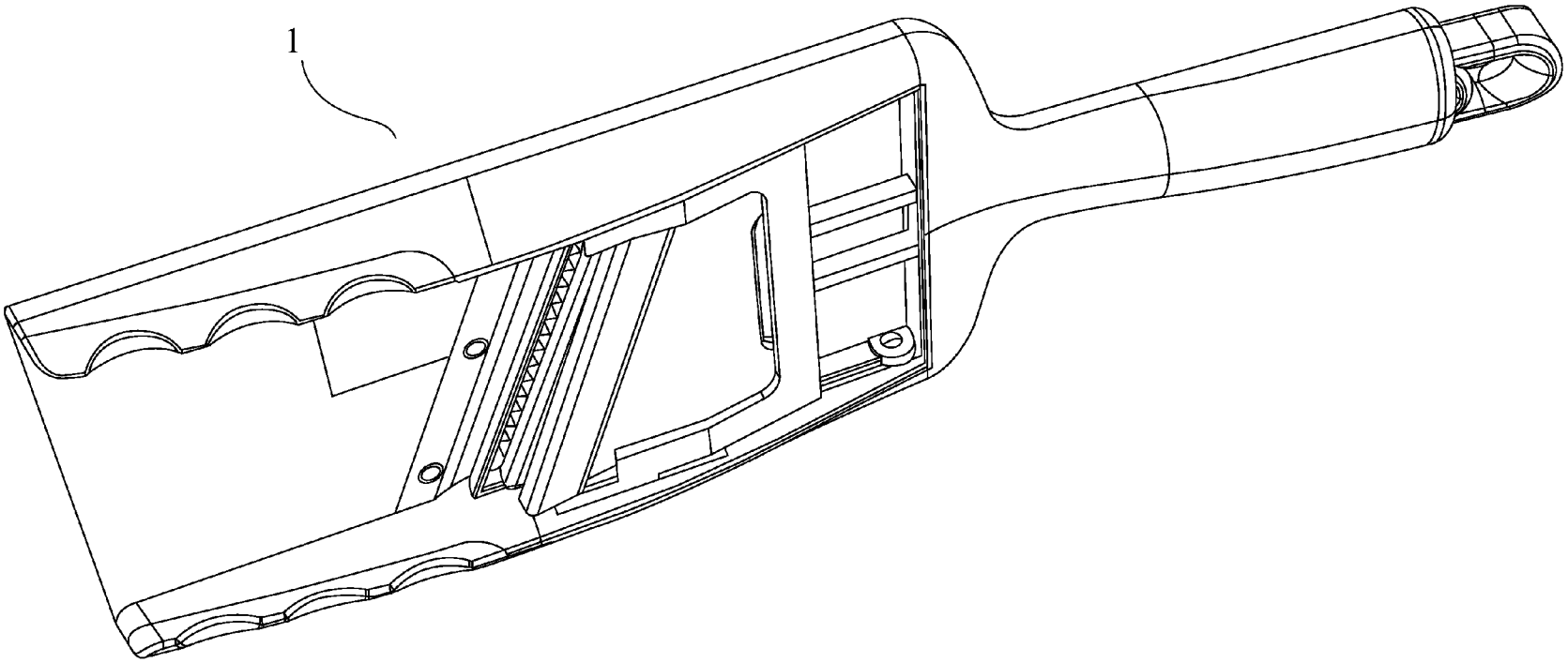
FIG. 2 is a bottom perspective view of the mandolin slicer shown in FIG. 1.
Figure 3:
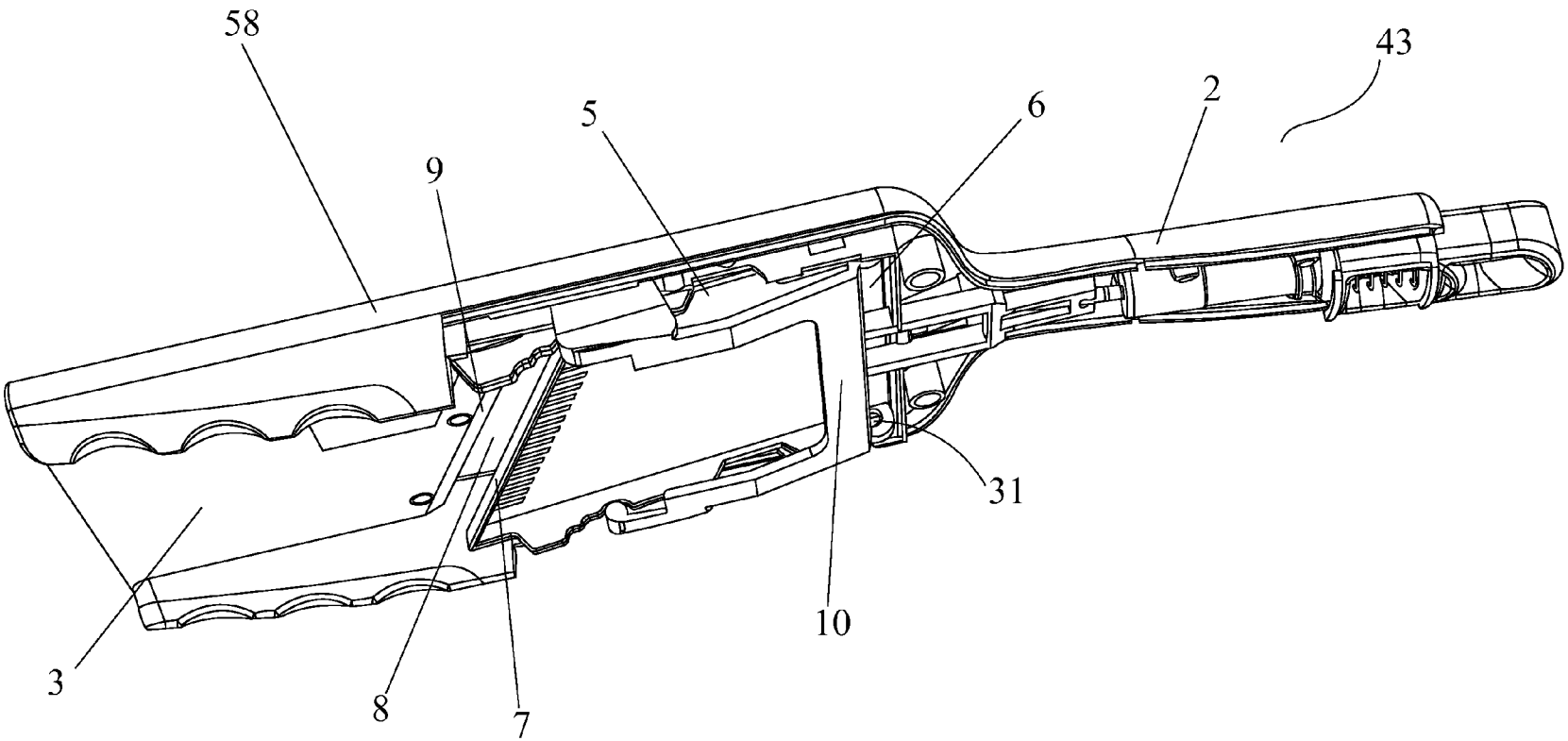
FIG. 3 is a perspective view of the mandolin slicer shown in FIG. 1 with the cutting plate and the lower halves of the handle and the frame being removed.

Referring now to the drawings, FIGS. 1 and 2 illustrate in perspective views a mandolin slicer according to a first embodiment of the present invention in an assembled state, while FIG. 3 shows the mandolin slicer with the lower halves of the handle and the frame removed for the sake of clarity. The mandolin slicer 1 essentially comprises a handle 2, a frame 58, a slicing plate 3, a guiding plate 5, a linkage 10 and an actuator assembly 43.

Figure 4:
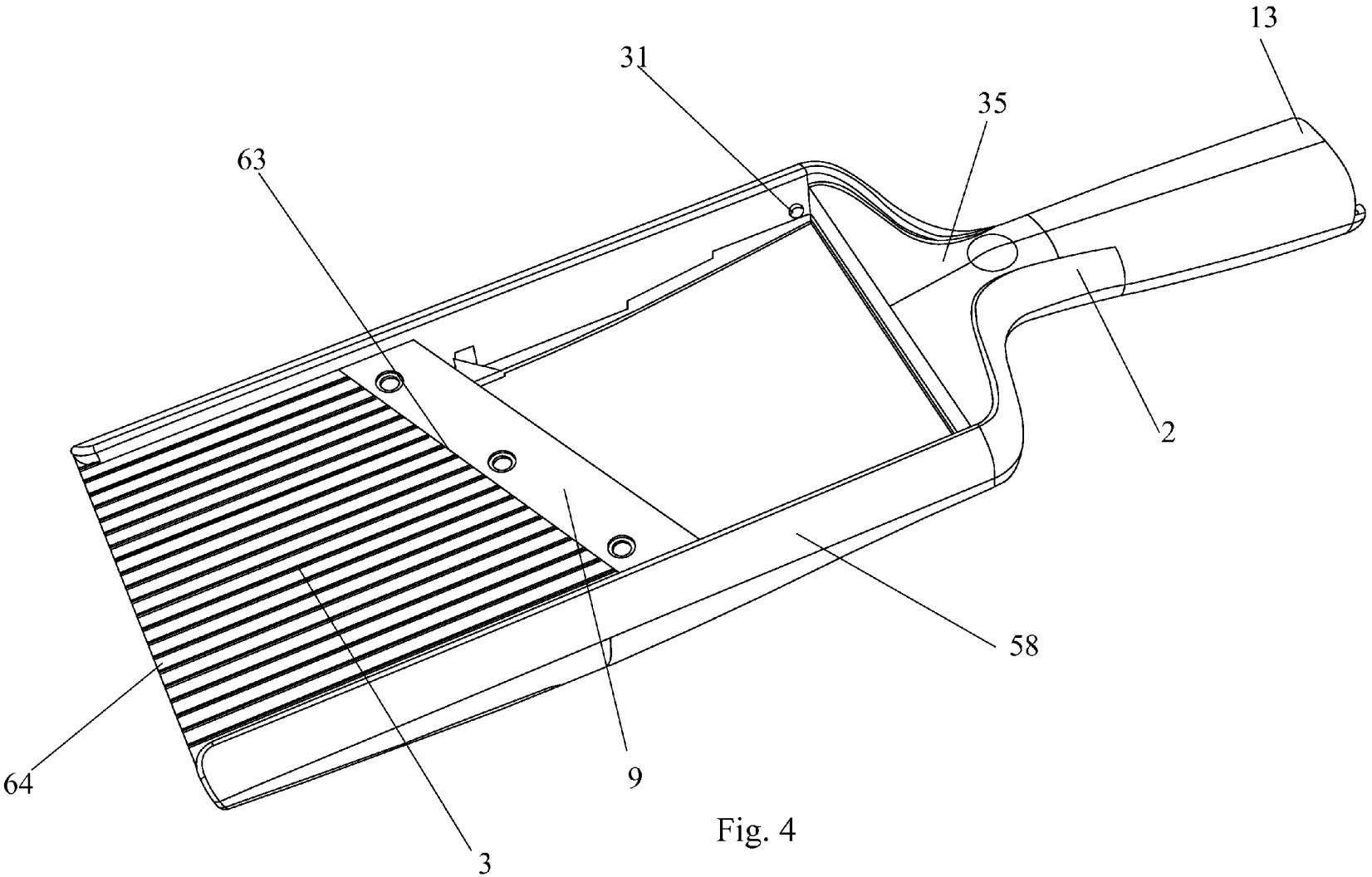
FIG. 4 is a perspective view of the handle, the frame and the slicing plate of the mandolin slicer shown in FIG. 1.

As can be seen in FIG. 4, the handle 2 has a first end 35 and a second end 13. The frame 58 extends from the first end 35 of the handle 2 in the form of two opposite side walls. Preferably, the handle 2 and the frame 58 are formed integrally. The slicing plate 3 is fixedly held between the two side walls of the frame 58. A sharp slicing blade 9 for slicing the items to be sliced is fixed on the rear edge 63 of the slicing plate 3. Alternatively, the slicing blade 9 may also be provided as a slicing edge formed integrally with the slicing plate 3. Preferably, the slicing blade 9 is provide at a slight angle with the front edge 64 of the slicing plate 3, in order to increase the effective width of the slicing blade 9.

As shown in FIG. 3, the guiding plate 5 has a proximal end 6 which is pivotally connected to the frame 58, and a distal end 7 which is positioned with a variable gap 8 formed between the distal end 7 and the slicing blade 9 of the slicing plate 3. In other words, the slicing plate 9 and the distal end 7 of the guiding plate 5 together define the gap as slice thickness for the item to be sliced.

In order to pivotally connect the proximal end 6 of the guiding plate 5 to the frame 58, a pair of hinges 31 are formed on the two side panels of the frame 58, respectively. Correspondingly, a pair of holes 42 (as can be best seen in FIG. 6) are formed on two opposite sides, respectively, of the proximal end 6 of the guiding plate 5. The proximal end 6 of the guiding plate 5 is pivotally connected to the frame 58 by inserting the hinges 31 into the corresponding holes 42, such that the gap 8 varies as the guiding plate 5 pivots around its proximal end 6.

Figure 5:
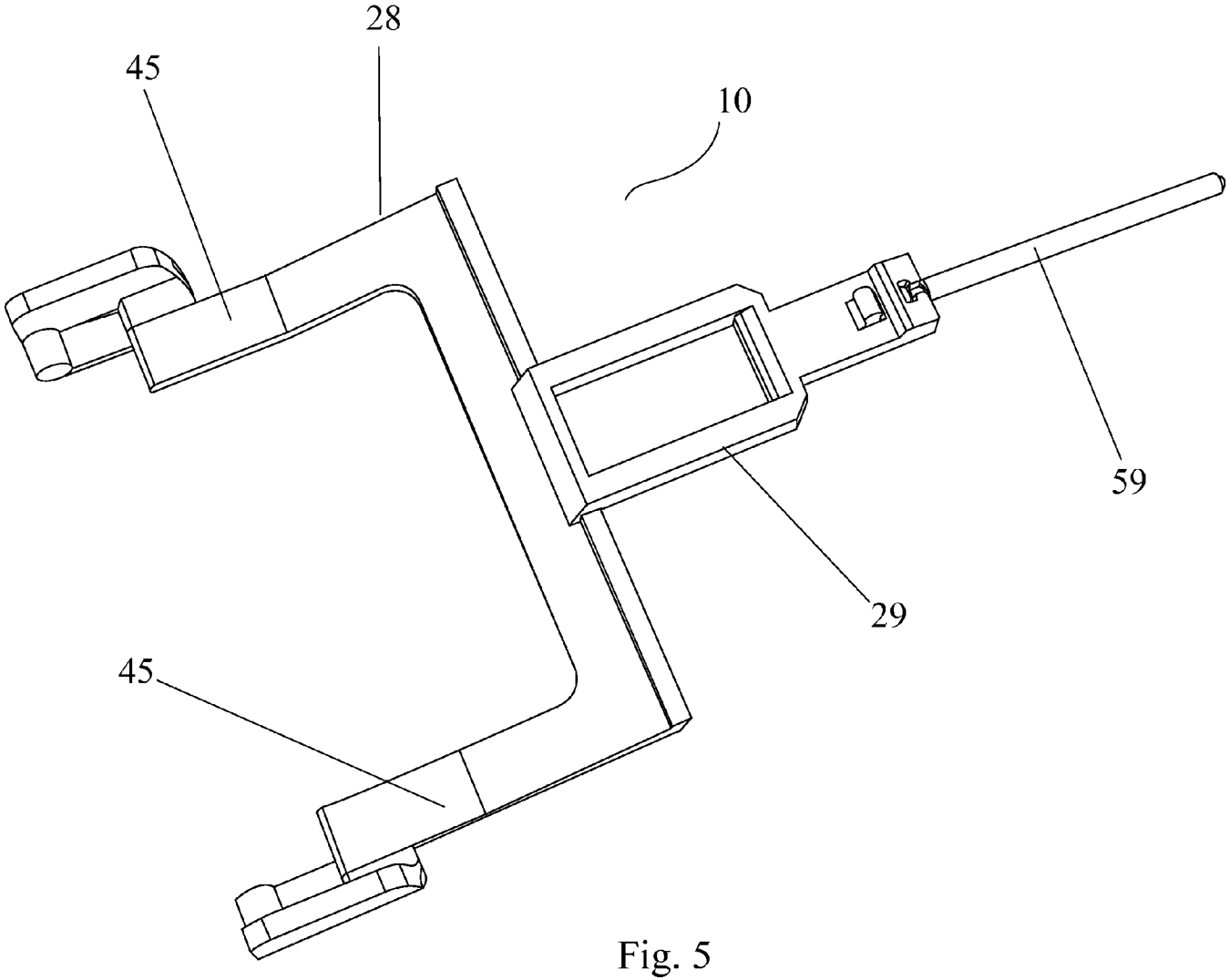
FIG. 5 is a perspective view of the linkage of the mandolin slicer shown in FIG. 1.
Figure 6:
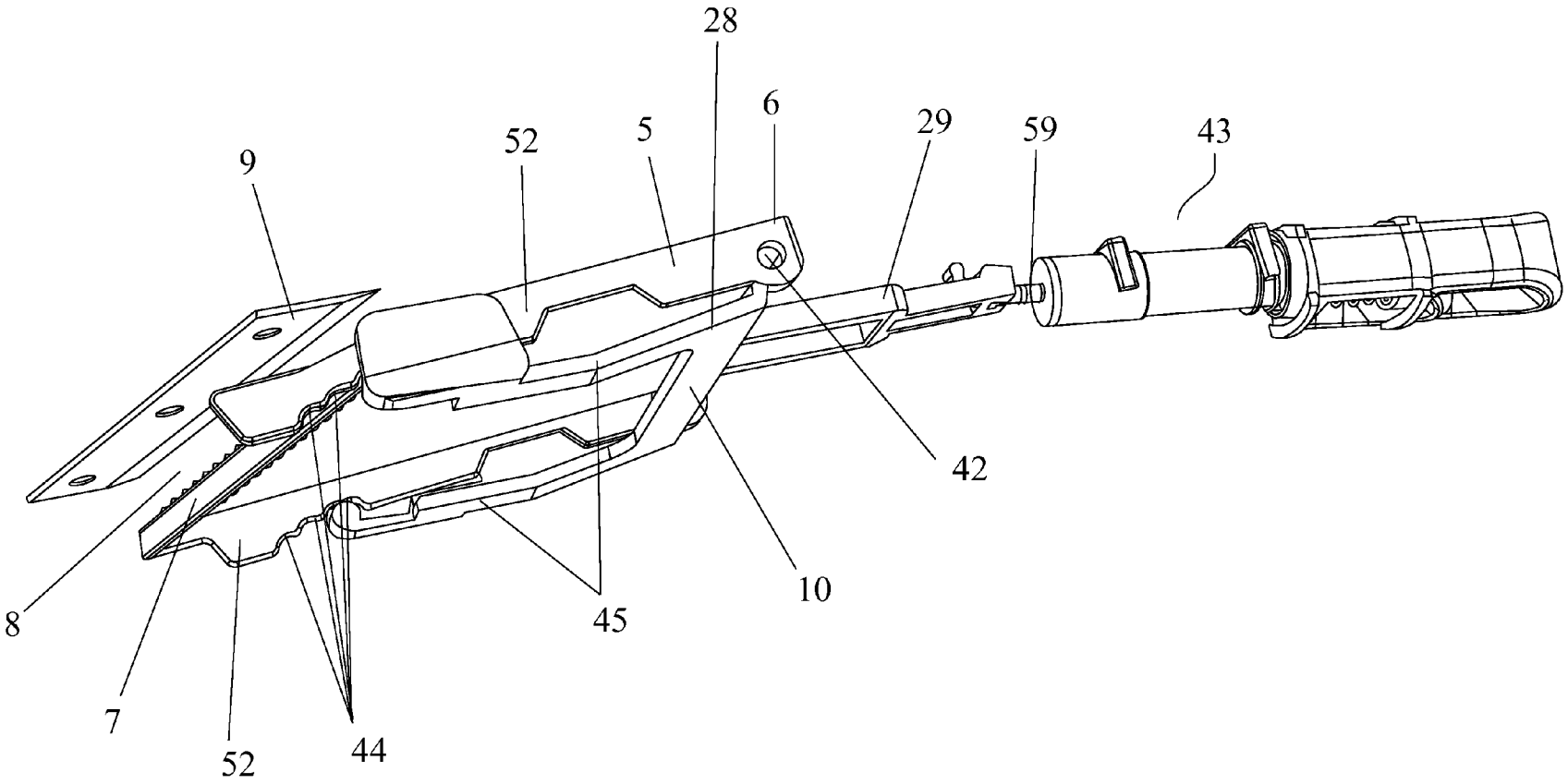
FIG. 6 is a perspective bottom view of the mandolin slicer shown in FIG. 1 with the handle, the frame, the slicing plate and the cutting plate being removed.
Figure 7:
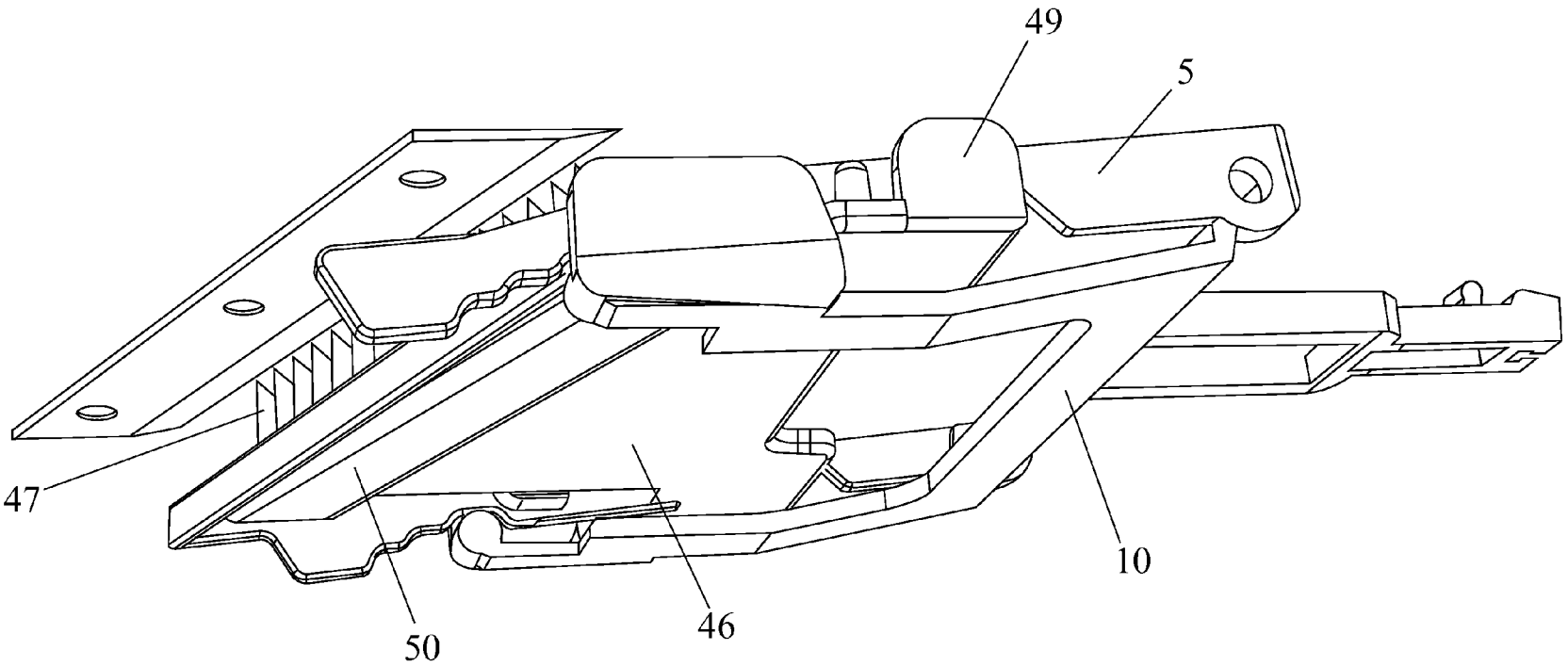
FIG. 7 is a perspective bottom view of the mandolin slicer shown in FIG. 1 with the handle, the frame, the slicing plate and the actuator assembly being removed.

As can be seen in FIG. 5, the linkage 10 comprises a first portion 28 having two legs 45, a second portion 29 integrally formed with the first portion 28, and a third portion 59 having one end rotatably coupled to the second portion 29 and the other end connected to the actuator mechanism 43. As shown in FIG. 3, the two legs 45 of the first portion 28 of the linkage 10 movably at their ends carry the guiding plate 5. The linkage 10 is configured to move to the plurality of carrying positions of the guiding plate 5 for carrying the guiding plate 5. The first portion 28 of the linkage 10 is placed within the frame 58, while the second portion 29 and the third portion 59 are accommodated within the handle 2 and the linkage 10 is longitudinally displaceable relative to the frame 58 and the handle 2. In this embodiment, every end of each of the two legs 45 the linkage 10 is terminated by a bump 55 which movably carries the guiding plate 5. More particularly, as shown in FIG. 6, a pair of lugs 52 are formed extending downwardly from two opposite sides, respectively, of the guiding plate 5, and multiple pairs of steps 44 are formed on a bottom surface of lugs 52, respectively in a direction of the movement of the linkage 10 to provide the plurality of carrying positions. When the linkage 10 moves to one pair of steps 44, the bumps 55 of the two legs 45 of the linkage 10 are in abutment against said pair of steps 44, creating a corresponding predetermined slice thickness.

As can be seen from the above description and in FIG. 6, when the linkage 10 is activated to move towards the slicing plate 3, the distal end 7 of the guiding plate 5 is forced to pivot towards the slicing blade 9 of the slicing plate 3 with the gap 8 becoming smaller, such that the slice thickness is becoming thinner; and when the linkage 10 is caused to move away from the slicing plate 3, the distal end 7 of the guiding plate 5 pivots away from the slicing blade 9 of the slicing plate 3 by gravity, with the gap 8 becoming larger. In other words, the longitudinal position of the linkage 10 determines the size of the gap 8, i.e. the variable slice thickness.

In this embodiment, three pairs of steps are formed on the bottom surface of lugs 52, in which the pair of steps farthest away from the slicing blade 9 are long enough to provide two carrying positions for the guiding plate 5 so that such two carrying positions both create the same predetermined large slice thickness. The carrying position farthest away from the slicing blade 9 is designated as a designated position where the slicing blade 9 is used in combination with the cutting teeth mounted on a cutting plate 46. The linkage 10 is able to move to and retain in any one of the three pairs of steps, among which the first three carrying positions provide three different predetermined slice thicknesses, and the designated position provides an option of using the slicing blade 9 in combination with the cutting teeth mounted on a cutting plate 46. In the designated position, the items to be sliced are subject to a cutting operation implemented by the cutting teeth 47 in combination with the slicing blade 9. Those skilled in the art would understand that the linkage 10 can also be configured to be able to move to any one of more or less than four carrying positions, according to practical needs.

Although one designated position is provided in this embodiment, it is possible to configure more than one carrying position as designated positions with reference to the above description of one designated position, which would be within the ability of a person skilled in the art.

As shown in FIGS. 7-11, the cutting plate 46 is arranged under the guiding plate 5. The cutting plate 46 has a first end portion 49 pivotally connected to the frame 58, and a second end portion 50. A plurality of cutting teeth 47 extend upwardly from the second end portion 50 of the cutting plate 46. The cutting plate 46 remains immobile when the linkage 10 moves to the first three carrying positions to allow for variable slice thicknesses. When the linkage 10 moves in a translational manner further in the pair of steps farthest away from the slicing blade 9 to the designated carrying position, the cutting plate 46 is permitted to move towards to the guiding plate to implement the cutting operation by the cutting teeth 47 in combination with the slicing blade 9 in the predetermined largest thickness.

Figure 8:
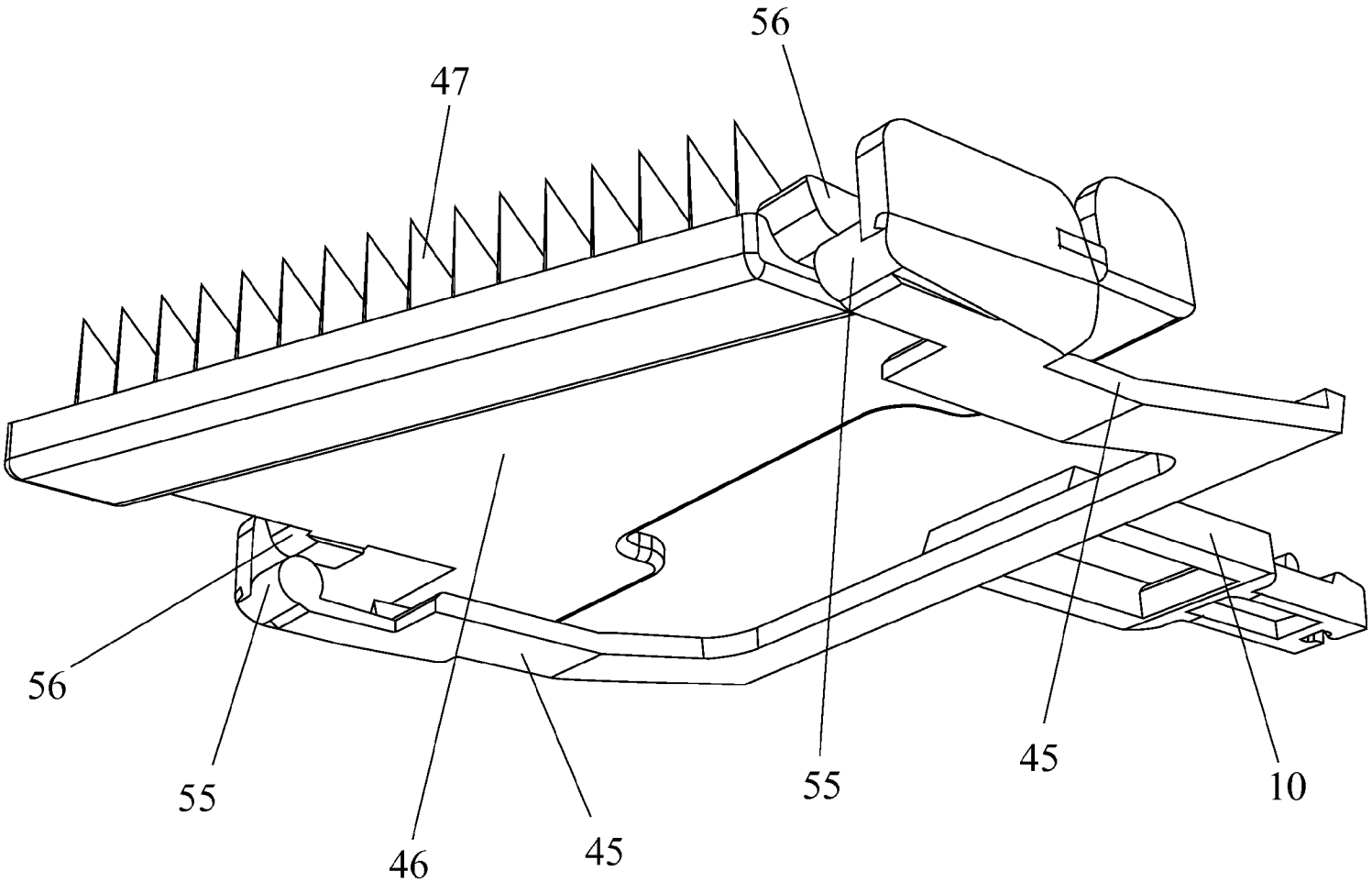
FIG. 8 is a perspective bottom view of the linkage and the cutting plate of the mandolin slicer shown in FIG. 1, wherein the linkage is in the designated carrying position.
Figure 9:
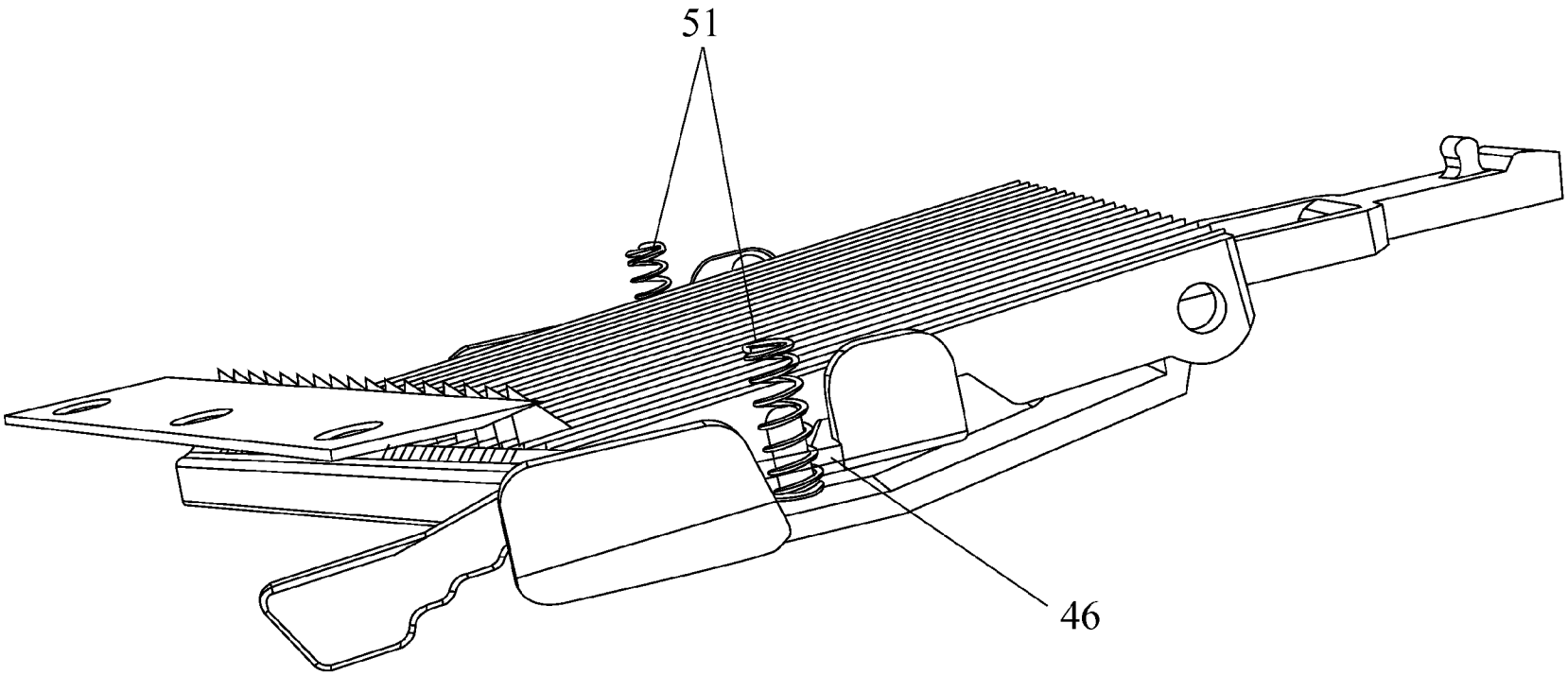
FIG. 9 is a perspective view of the linkage, the guiding plate, the cutting plate and the slicing blade of the mandolin slicer shown in FIG. 1, wherein the linkage is in the designated carrying position.
Figure 10:
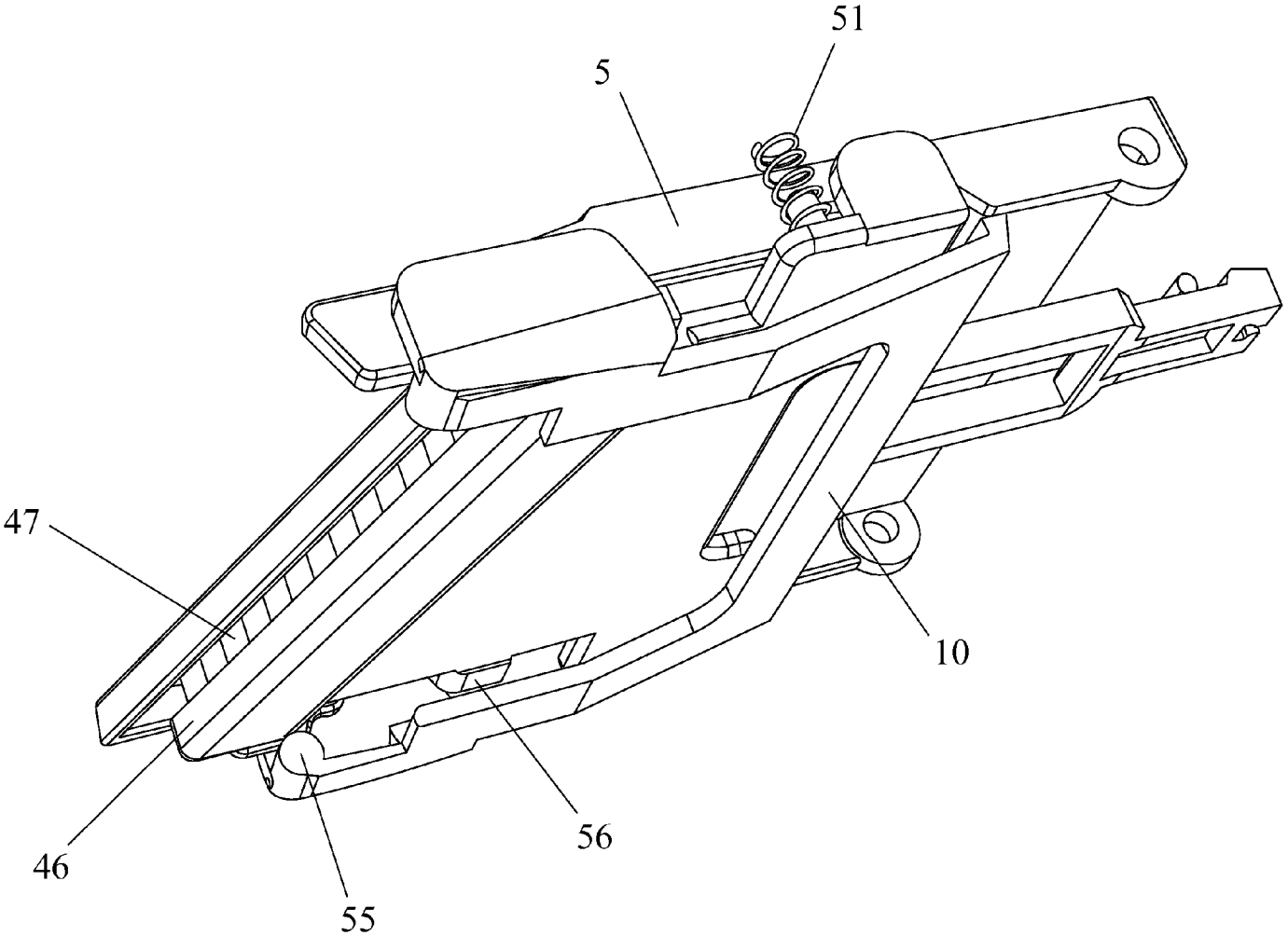
FIG. 10 is a perspective bottom view of the linkage, the guiding plate and the cutting plate of the mandolin slicer shown in FIG. 1, wherein the linkage moves out of the designated carrying position.
Figure 11:
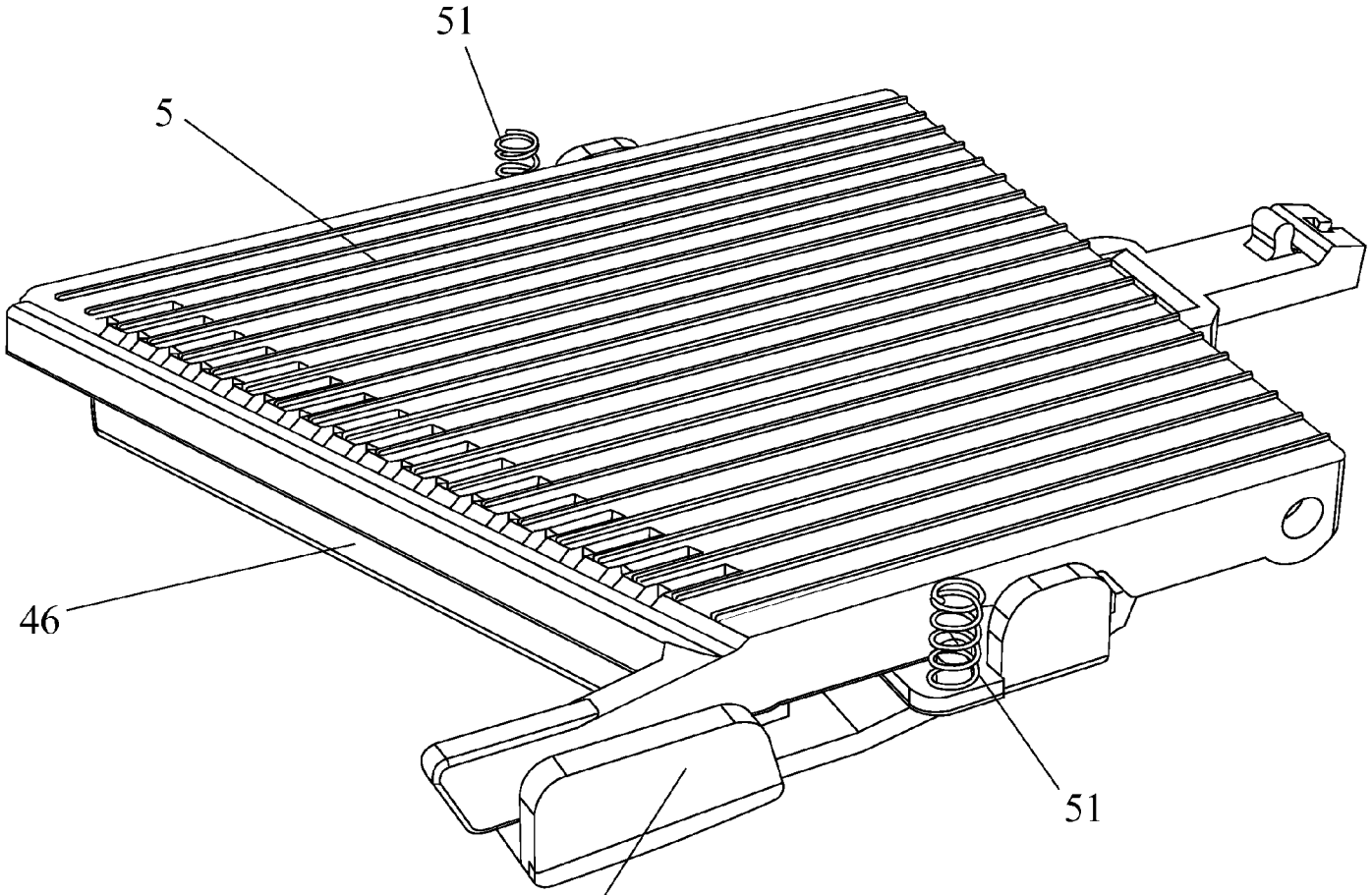
FIG. 11 is a perspective top view of the linkage, the guiding plate and the cutting plate shown in FIG. 10.
Figure 12:
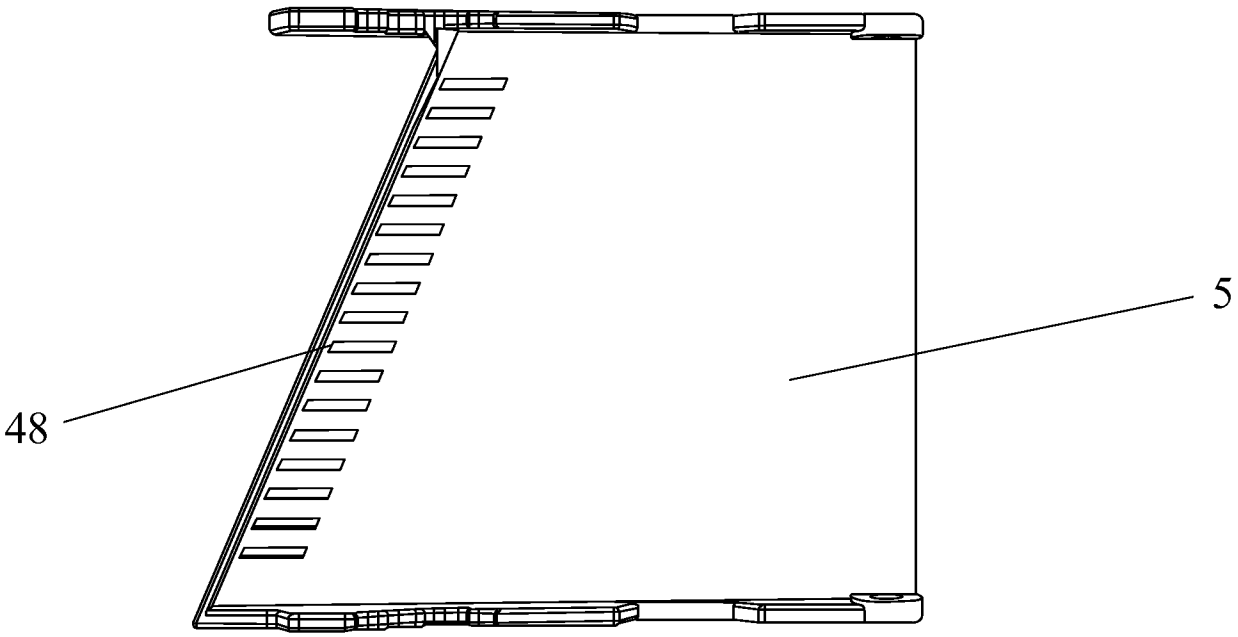
FIG. 12 is a top view of the guiding plate of the mandolin slicer shown in FIG. 1.

A pair of protrusions 56 corresponding to the pair of bumps 55 of the linkage 10 are formed on two opposite sides, respectively, of the cutting plate 46. A pair of springs 51 are provided each having one end fixed to a respective side of the cutting plate 46 on two opposite sides thereof, respectively, to bias the cutting plate 46 to pivot downwardly. As shown in FIGS. 8 and 9, when the linkage 10 moves to the designated carrying position, the bumps 55 press against the corresponding protrusions 56, causing the cutting plate 46 to pivot upwardly, with a result of the cutting teeth 47 protruding beyond the guiding plate 5 through slots 48 formed in the guiding plate 5 in the vicinity of the distal end 7 (see FIG. 12), such that the item to be sliced is also cut by the cutting teeth 47, for example, into strips, that is, the item to be sliced is subject to the cutting operation implemented by the cutting teeth 47 in combination with the slicing blade 9. As shown in FIGS. 10 and 9, when the linkage 10 moves out of the designated carrying position, the cutting plate 46 is biased by the springs 51 to pivot downwardly, causing the cutting teeth 47 to be released from the guiding plate 5, such that the item to be sliced is not in contact with the cutting teeth 47, that is, the item to be sliced is subject to a cutting operation implemented by the slicing blade 9 only.

An actuator assembly is provided to move the linkage 10 longitudinally and to lock the linkage 10 in one of the four carrying positions. In this embodiment, the actuator assembly is configured as a ballpoint pen ratchet mechanism 12 in operative connection with the linkage 10, such that, every time the ballpoint pen ratchet mechanism 12 is activated, for instance pressed downwardly and then released, the linkage 10 is displaced from one of the four carrying positions to another. However, any other mechanism can be used in order to displace and lock the linkage 10.

Figure 13:
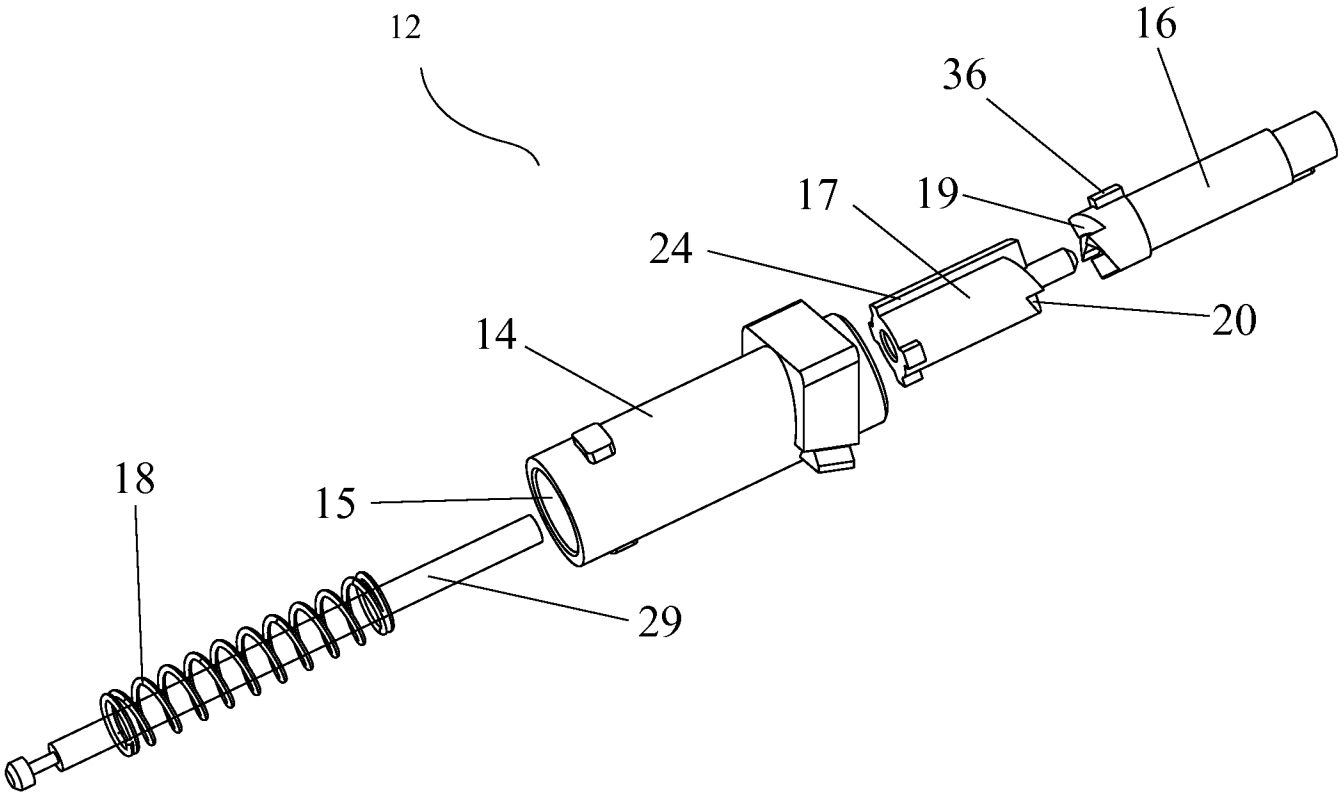
FIG. 13 is a perspective exploded view of the actuator assembly of the mandolin slicer shown in FIG. 1.
Figures 14A, 14B, 14C, 14D:
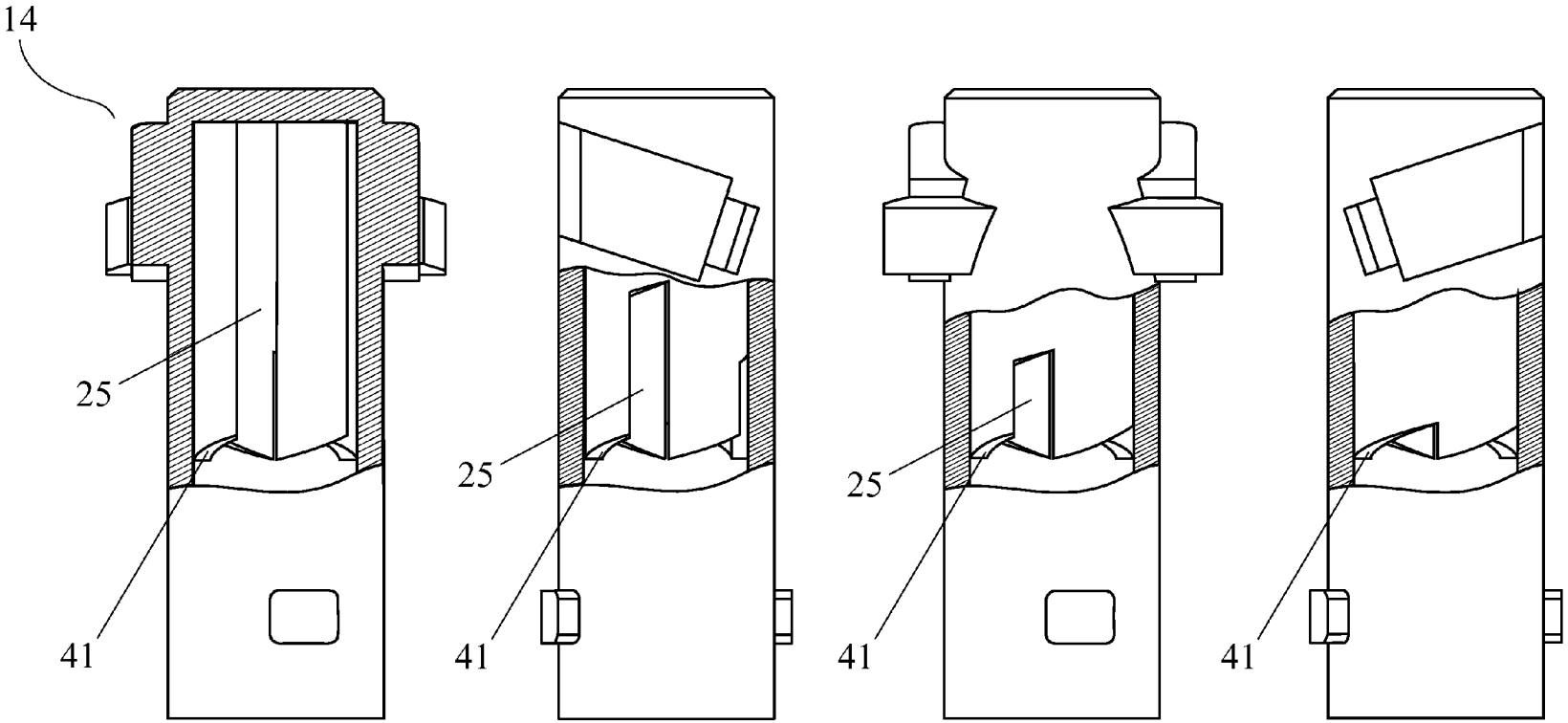
FIG. 14*a* is a side view, partially broken away and partially in hidden view, of the sleeve of the actuator assembly shown in FIG. 13.
FIG. 14*b* is a view similar to that in FIG. 14*a* but with the sleeve being rotated by 90 degrees in the clockwise direction when viewed from above.
FIG. 14*c* is a view similar to that in FIG. 14*a* but with the sleeve being rotated by 180 degrees in the clockwise direction when viewed from above.
FIG. 14*d* is a view similar to that in FIG. 14*a* but with the sleeve being rotated by 270 degrees in the clockwise direction when viewed from above.
Figure 15:
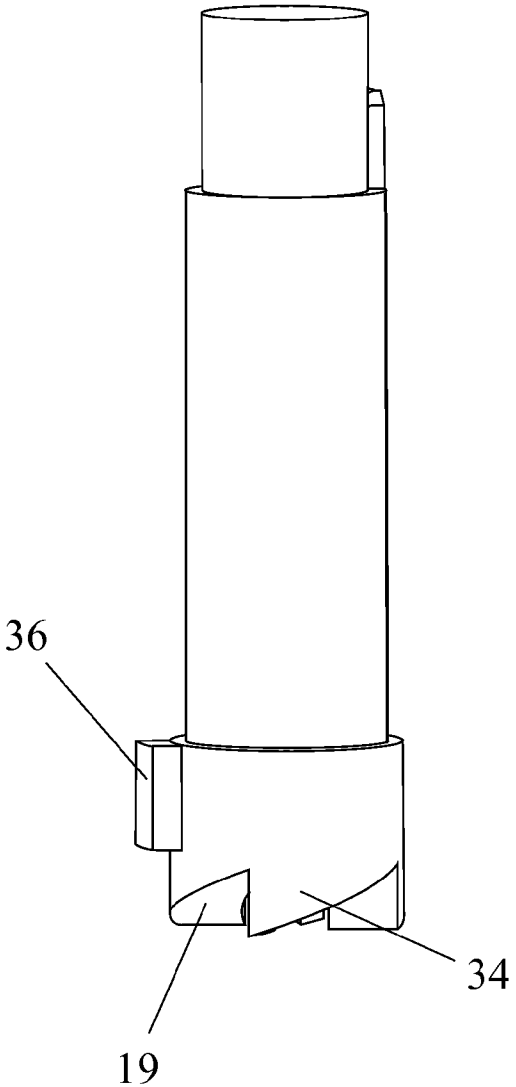
FIG. 15 is a perspective view of the push plunger of the actuator assembly shown in FIG. 13.

Referring to FIGS. 13-16, the ballpoint pen ratchet mechanism 12 will now be explained in details. As shown in FIG. 13, the ballpoint pen ratchet mechanism comprises a sleeve 14, a push plunger 16, a ratchet 17 and a compression spring 18. FIGS. 14*a*-14*d* illustrate in a partially broken away side view the sleeve 14. The sleeve 14 is fixedly accommodated in the handle 2, and has a longitudinal throughbore 15. The push plunger 16 as shown in FIG. 6 is partially received in the throughbore 15. As can be seen in FIG. 15, the push plunger 16 is shaped as a hollow cylinder with four downwardly extending portions 34 arranged evenly on the circumference of the bottom of the hollow cylinder. Each of the downwardly extending portions 34 has a bottom cam face 19. A protrusion 36 is formed on an outer surface of the push plunger 16. The protrusion 36 is received and slidable in a longest one of four slots 25 formed in an inner surface of the sleeve 14 (see FIGS. 14*a*-14*d*). Therefore, the push plunger 16 is non-rotatable but longitudinally displaceable relative to the sleeve 14. The push plunger 16 is fixedly connected to a button 30 which extends beyond the second end 13 of the handle 2 and which is configured to be pressed by a user of the slicer.

Figure 16:
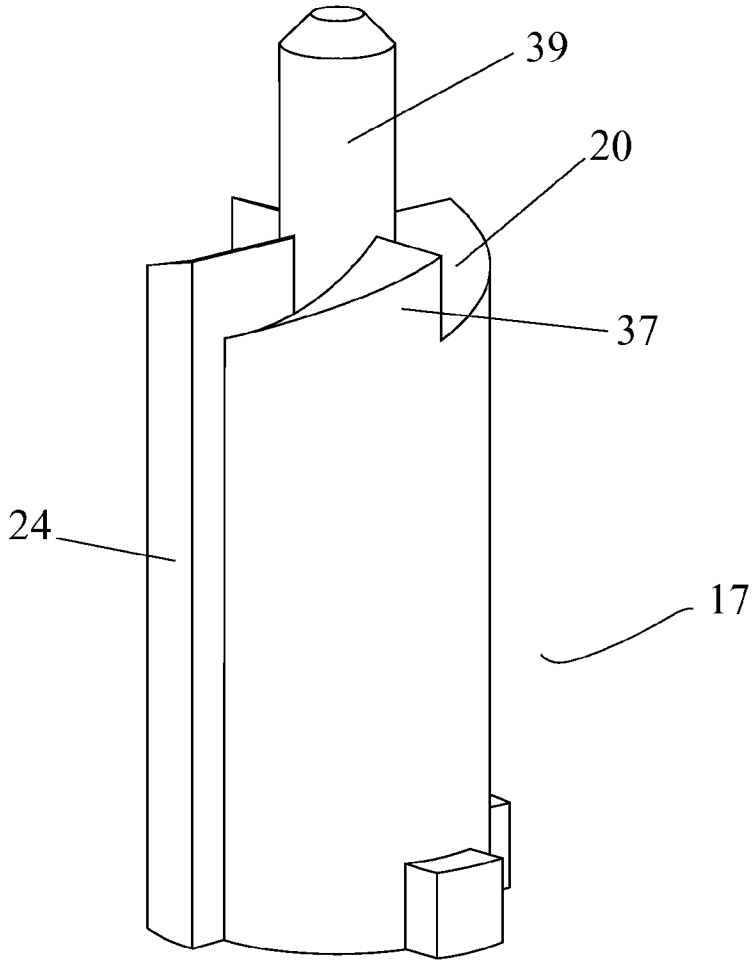
FIG. 16 is a perspective view of the ratchet of the actuator assembly shown in FIG. 13.

As shown in FIG. 16, the ratchet 17 is also shaped as a hollow cylinder with an outer diameter substantially identical to that of the push plunger 16. Four upwardly extending portions 37 are formed evenly on the circumference of the top of the hollow cylinder. Each of the upwardly extending portions 37 has a top cam face 20 which cooperates with each of the four cam faces 19 of the push plunger 16 when the push plunger 16 is pressed against the ratchet 17. A stub 39 extends from the center of the top of the ratchet 17, and is received within the hollow cylinder of the push plunger 16 when the push plunger 16 is pressed against the ratchet 17. An axially extending rib 24 is formed on an outer surface of the ratchet 17. The rib 24 is engagable with any one of the four slots 25 formed in the inner surface of the sleeve 14. Due to the cooperating cam faces 19 and 20, when the push plunger 16 is forced downwardly against the ratchet 17 causing the rib 24 to disengage from the slots 25, the ratchet 17 tends to rotate relative to the sleeve 14 in the anti-clockwise direction when viewed from the top (as the push plunger 16 is non-rotatable relative to the sleeve 14). The linkage 10 is coupled to the ratchet 17 in such a manner that the longitudinal displacement of the ratchet 17 causes the linkage 10 to displace longitudinally on the guiding plate 5. A compression spring 18 is provided to constantly apply an upward force to the ratchet 17 to enable the ratchet 17 move upward after the pressure onto the ratchet is released.

The four slots 25 formed on the inner surface of the sleeve 14 are of different lengths and the rib 24 is rotated to alternately engage with one of the four slots. Therefore, the slots serve as position establishing devices which hold the ratchet 17 selectively and alternately in one of four axially spaced carrying positions depending on the angle of rotation of the ratchet 17 while the four carrying positions of the ratchet 17 are respectively correspondent to the four predetermined carrying positions of the linkage 10. For each of the slots 25, each of the opposite sides defining the slot is adjacent to a cam face 41 at the end of the side. The bottom cam faces 41 are configured to cooperate with the cam faces 20 of the ratchet 17 when the ratchet 17 is pushed upwardly by the compression spring 18, causing the ratchet 17 to rotate further relative to the sleeve 14 in the anti-clockwise direction when viewed from the top. The cam faces 41 adjacent to the end of the slots are formed at a same height circumferentially. As the rib 24 of the ratchet 17 engages with one of the slots 25, the length of the slot 25 with which the rib 24 engages determines the longitudinal carrying position where the ratchet 17 is locked, which in turn determines the position of the linkage 10, and consequently the gap 8.

Thus, to move the linkage 10 from one of the four carrying positions to another, the push plunger 16 is first pressed (for example, by a finger of a user) downwardly against the ratchet 17. When the rib 24 of the ratchet 17 is pushed downwardly to disengage from the slots 25, the ratchet 17 rotates in the anti-clockwise direction when viewed from the top. Then the downward pressure applied to the push plunger 16 is released (for example, by removing the finger of the user), and both the push plunger 16 and the ratchet 17 are forced to move upwardly by the compression spring 18. As the ratchet 17 moves upwardly, the cam faces 20 thereof come into contact with the bottom cam faces 41 adjacent to the slot 25, causing the ratchet 17 to rotate further in the anti-clockwise direction when viewed from the top. Depending on the angle of rotation of the ratchet 17, the rib 24 slides into one of the slots 25, and the latched position of the ratchet 17 is determined by the length of said one of the slots 25 into which the rib 24 slides. When the push plunger 16 is pressed downwardly and then released again, the above described process occurs again, moving the ratchet 17 to the next latched position, and consequently moving the linkage 10 to the next one of the four carrying position. In other words, every time the push plunger 16 is pressed downwardly and then released, the ratchet 17, and consequently the linkage 10, is selectively and alternately held in one of four axially spaced positions, which correspond to three pairs of steps, i.e. three slice thicknesses. When the linkage 10 held in the carrying position farthest away from the slicing blade 9, which is also called designated position, the item to be sliced is allowed to be subject to a cutting operation implemented by the cutting teeth 47 in combination with the slicing blade 9.

Figure 17:
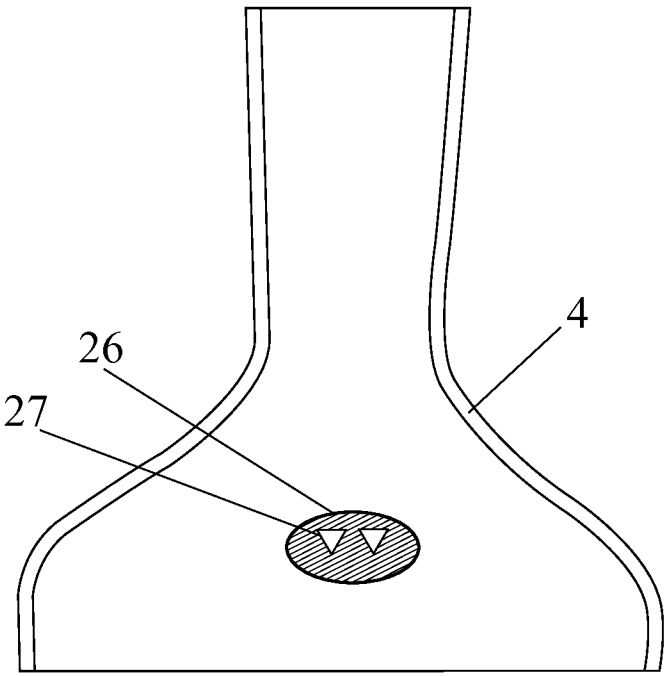
FIG. 17 is a top view of the indicating mechanism of the mandolin slicer shown in FIG. 1.
Figure 18:
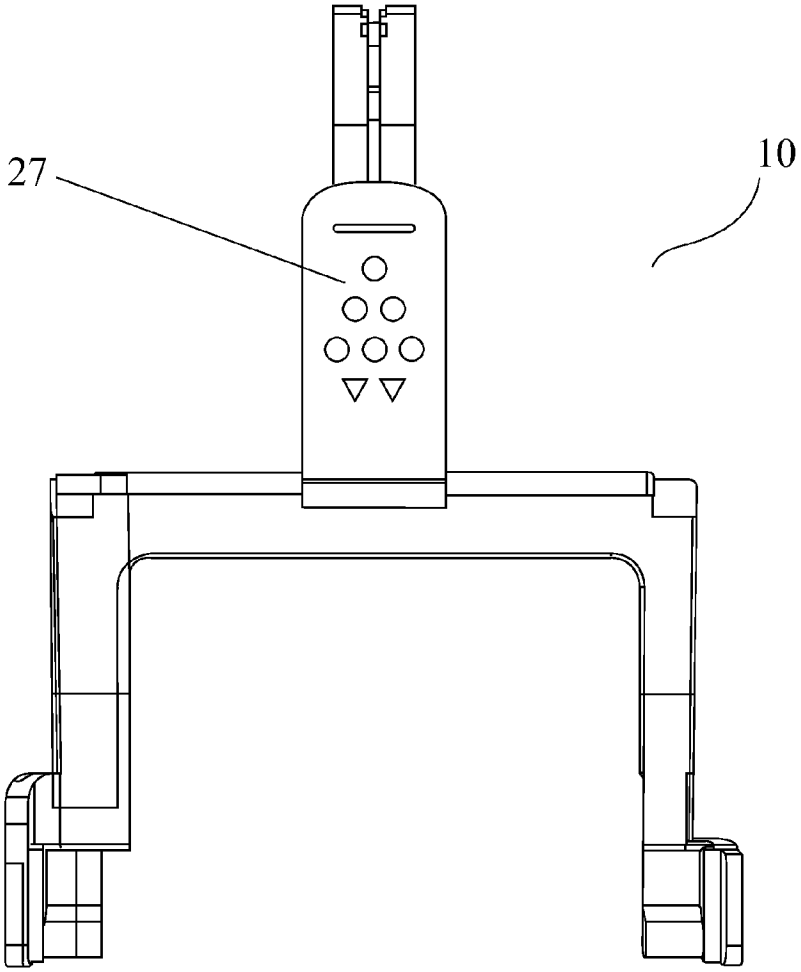
FIG. 18 is a front view of the linkage of the mandolin slicer shown in FIG. 1.
Figure 19:
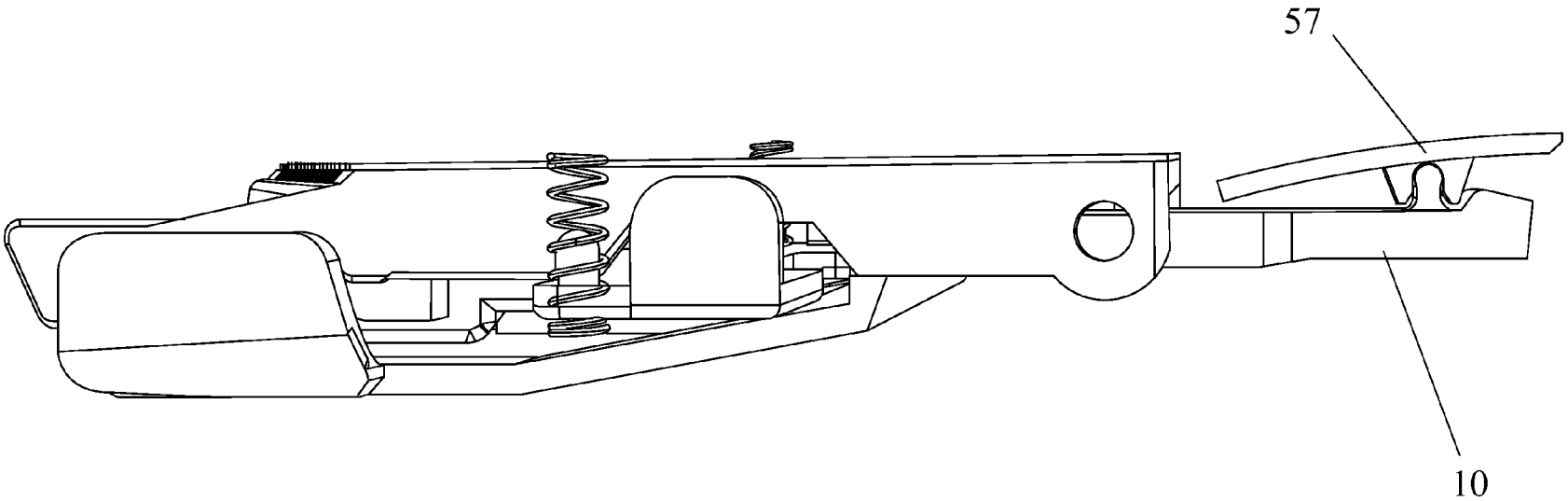
FIG. 19 is a perspective view of the linkage and the indicator plate fixed thereon in the mandolin slicer shown in FIG. 1.
Figure 20:
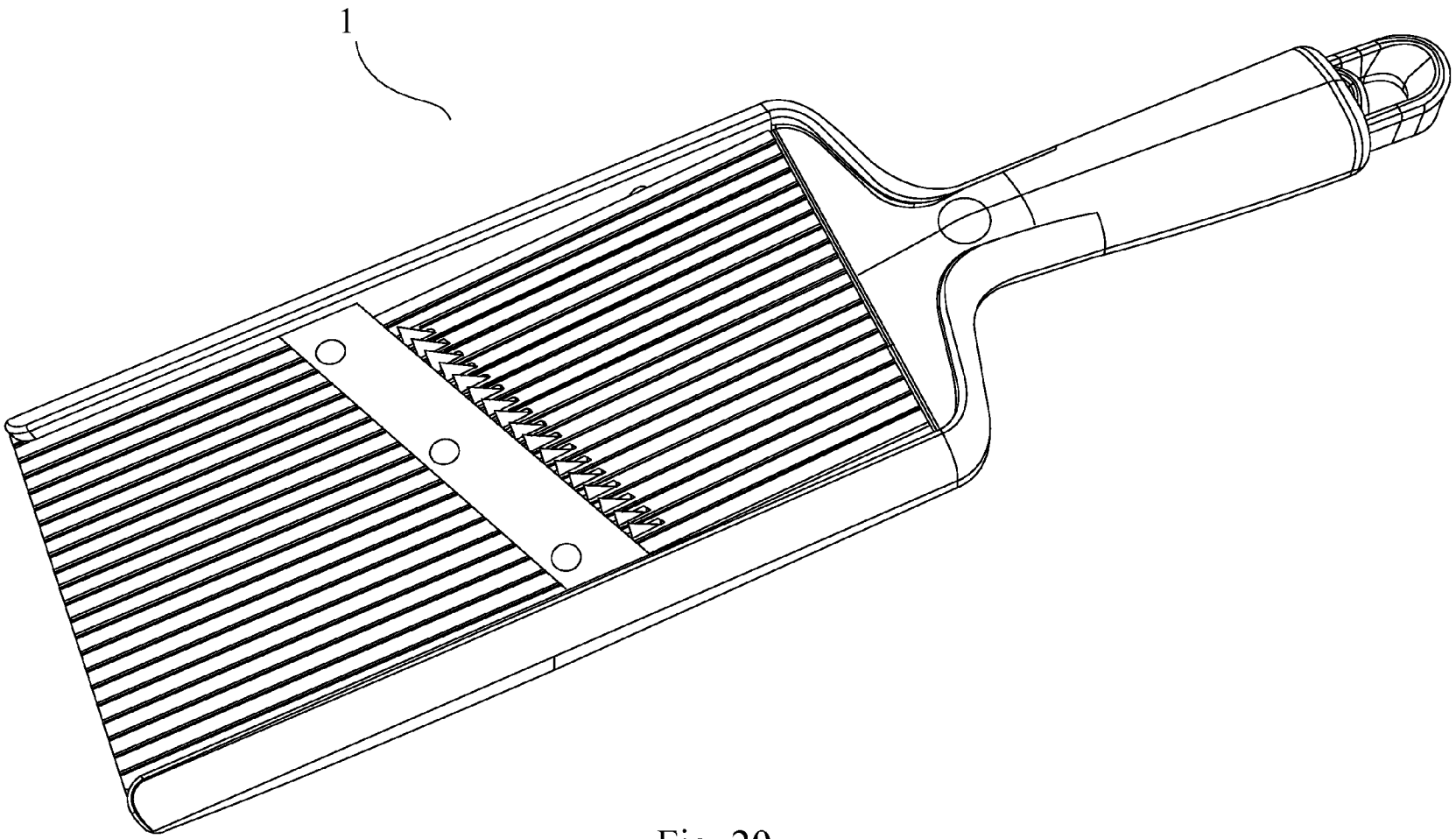
FIG. 20 is a perspective top view of a mandolin slicer according to a second embodiment of the present invention in an assembled state.
Figure 21:
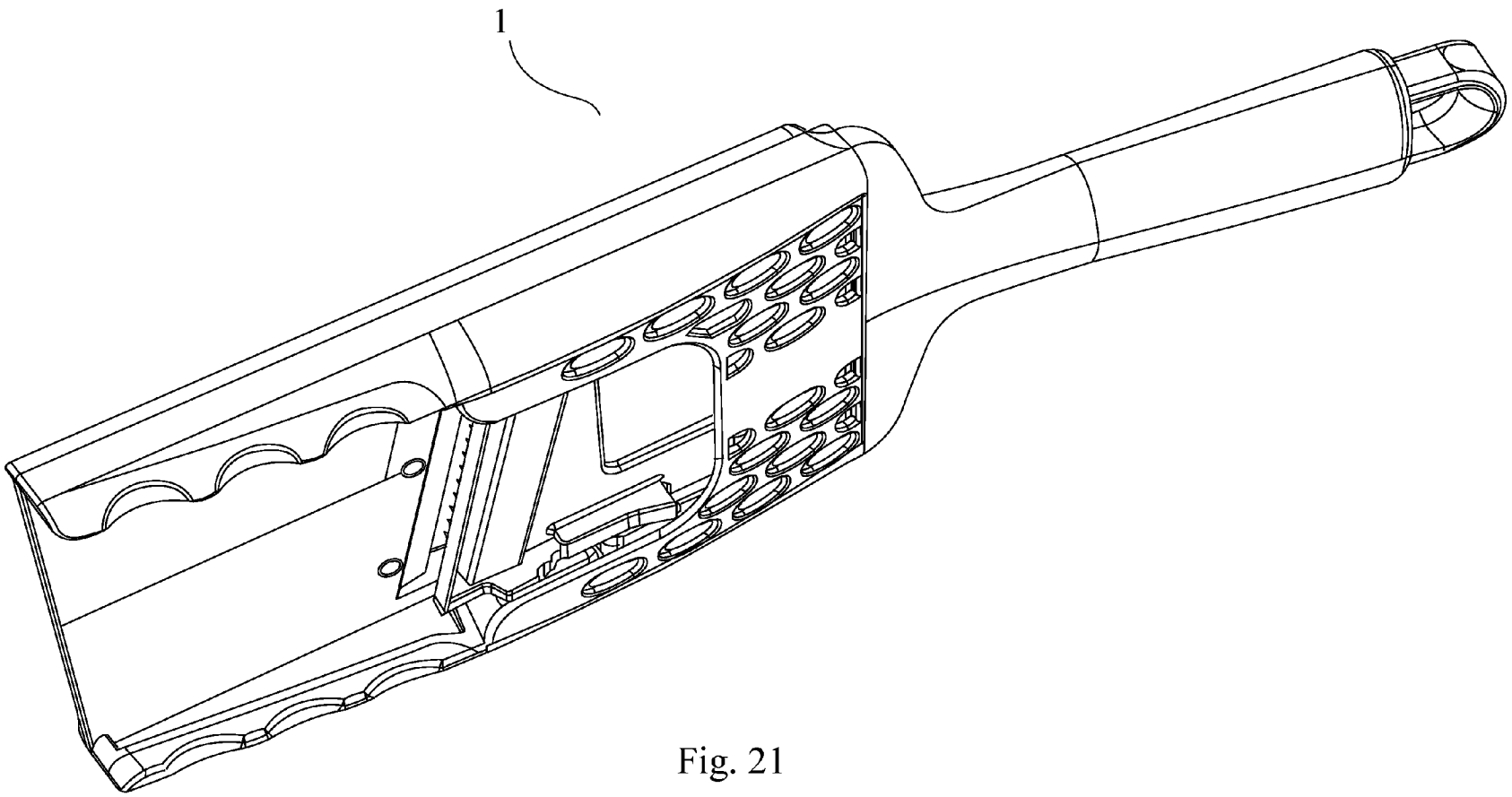
FIG. 21 is a bottom perspective view of the mandolin slicer shown in FIG. 20.
Figure 22:
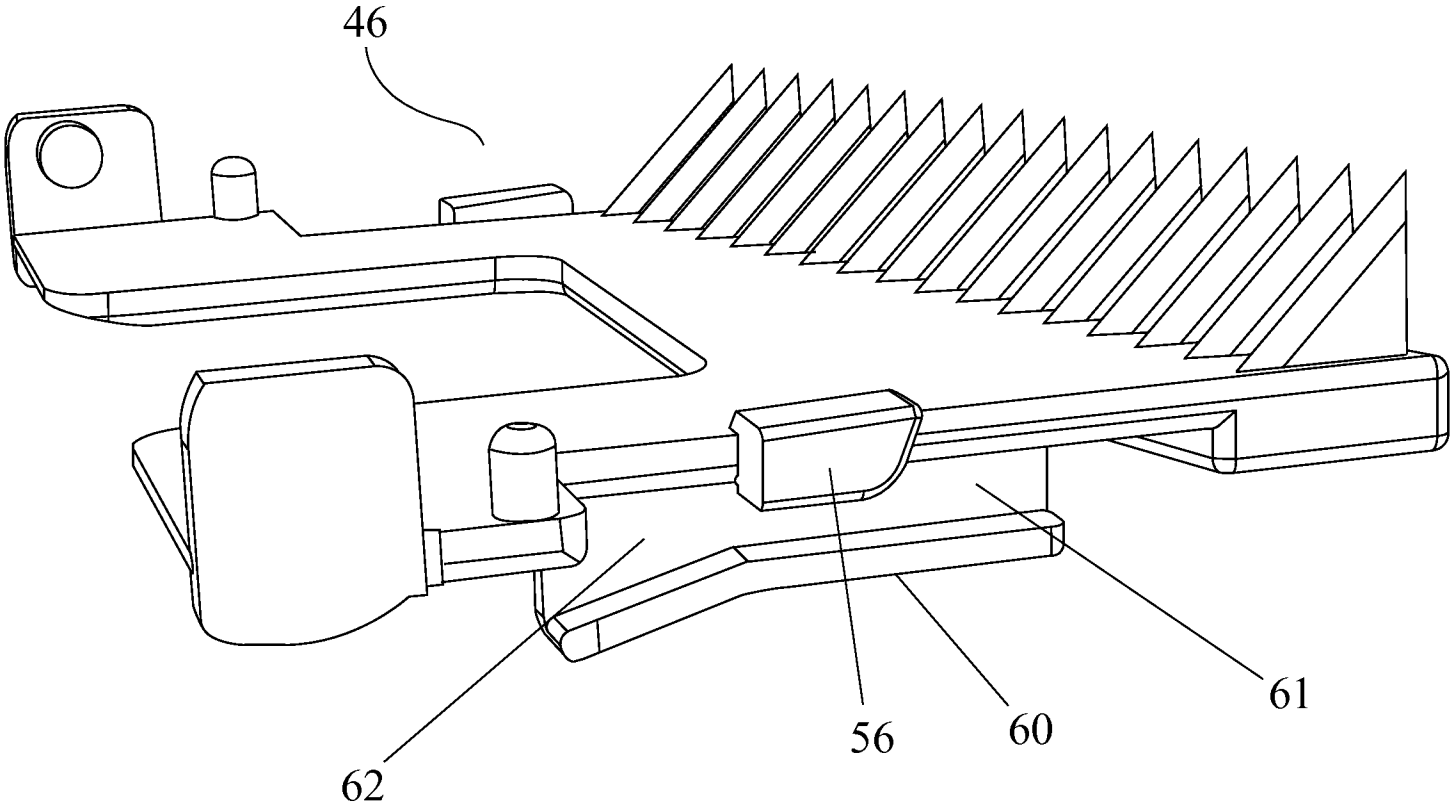
FIG. 22 is a perspective view of the cutting plate of the mandolin slicer shown in FIG. 20.
Figure 23:
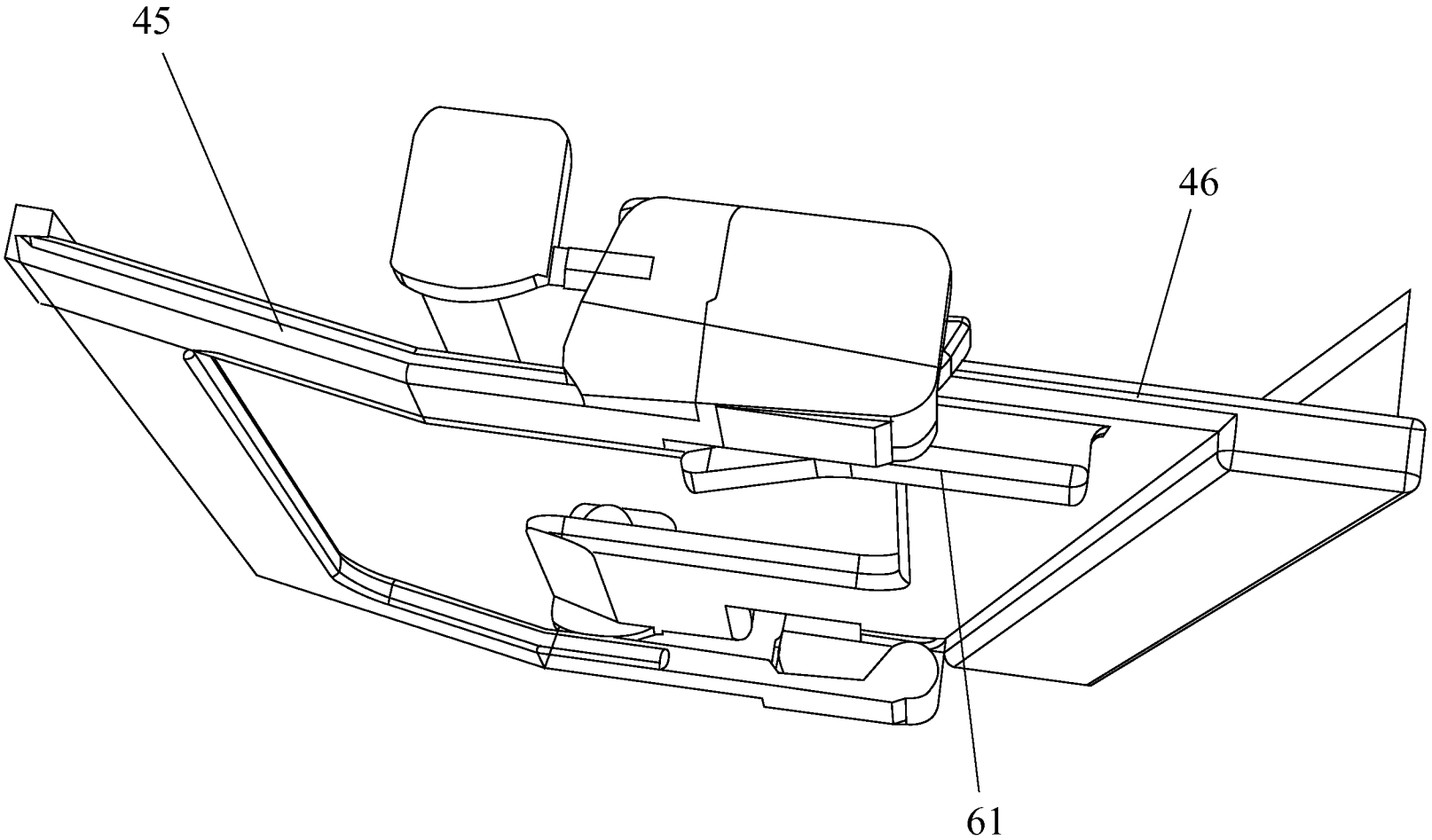
FIG. 23 is a perspective bottom view of the cutting plate and the linkage of the mandolin slicer shown in FIG. 20.
Figure 24:
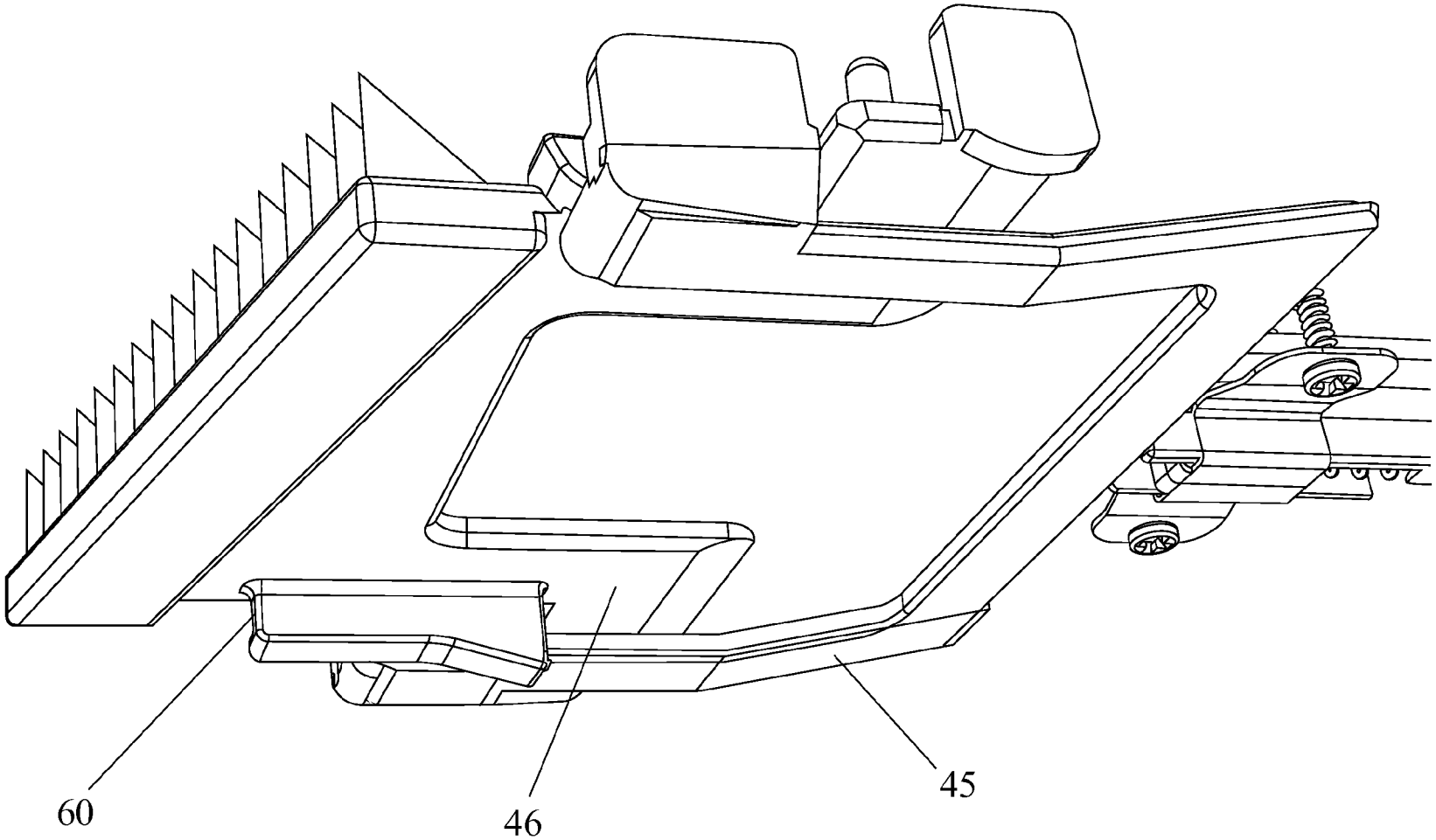
FIG. 24 is another perspective bottom view of the cutting plate and the linkage of the mandolin slicer shown in FIG. 20.

To clearly indicate how much the slice thickness to be selected is and where is the designated position, the mandolin slicer of the present invention further comprises an indicating mechanism, which is illustrated in FIGS. 17-19. FIG. 17 shows an indicating window 26 is formed on top of the handle 2, and FIG. 18 shows four indicators 27 are arranged in sequence on the linkage 10 to move with the latter. Alternatively, as shown in FIG. 19, the indicators 27 may also be arranged on an indicator plate 57, which is fixed on the linkage 10. The four indicators 27 can be four indicating symbols like "○", "○○", "○○○" and "ΔΔ" as shown in FIG. 18, which correspond to the slice thicknesses "S", "M", and "L" and the designated carrying position of the linkage 10, respectively. The four indicators 27 are positionally spaced to correspond to the respective four carrying positions of the linkage 10, thereby creating a correspondence between the indicators 27 and the predetermined slice thicknesses and the designated position. In operation, the indicator 27 corresponding to the selected carrying position is caused to move to a position where the indicating window 26 is located and exposed through the indicating window 26. Such an indicating mechanism allows the user to accurately know the thickness of the item slices and whether the item to be sliced will also be cut by the cutting teeth, prior to slicing the item.

FIGS. 20-24 show a mandolin slicer according to a second embodiment of the present invention, which is structurally similar to the first embodiment except for the biasing device used for the cutting plate 46. In particular, the pair of springs 51 for biasing the cutting plate 46 to pivot downwardly in the first embodiment discussed above is replaced by a guiding trough 60, which is formed integrally with the cutting plate 46 beneath one of the protrusions 56 for receiving a leading portion of the respective leg 45. The guiding trough 60 comprises a first portion 61 having a constant width and a second portion 62 extending from the first portion 61 and having an incrementally increasing width. The width of the first portion 61 is sized to purposely constrain the cutting plate 46 in place when the leading portion of the leg 45 is received therein until the bumps 55 press against the protrusions 56 where the leading portion of the leg 54 moves to the second portion 62, and the increasing width of the second portion 62 is sized to release the constraint of the cutting plate 46 and allow the cutting plate 46 to pivot upwardly. In other words, when the linkage 10 moves into the designated carrying position, the leading portion of one of the legs 45 is received in the second portion 62, which has a larger width than the first portion 61, such that the cutting plate 46 is allowed to pivot upwardly, causing the cutting teeth 47 to protrude beyond the cutting plate 46 through the slots 48. When the linkage 10 moves out of the designated carrying position, the leading portion of the same leg moves to be received in the first portion 61, which has a smaller width than the second portion 62, causing the cutting plate 46 to pivot downwardly, such that the cutting teeth 47 is released from the cutting plate 46.

While the present invention is described in connection with what is presently considered to be the most practical and preferred embodiment, it should be appreciated that the invention is not limited to the disclosed embodiment, and is intended to cover various modifications and equivalent arrangements included within the spirit and scope of the claims. Modifications and variations in the present invention may be made without departing from the novel aspects of the invention as defined in the claims, and this application is limited only by the scope of the claims.

NUMERICAL REFERENCES

1 mandolin slicer
2 handle
3 slicing plate
5 guiding plate
6 proximal end of the guiding plate
7 distal end of the guiding plate
8 gap
9 slicing blade
10 linkage
12 ballpoint pen ratchet mechanism
13 second end of the handle
14 sleeve
16 push plunger
17 ratchet
18 compression spring
19 cam faces of the push plunger
20 cam faces of the ratchet
24 rib
25 slot
26 indicating window
27 indicator
28 first portion of the linkage
29 second portion of the linkage
30 button
31 hinge
34 downwardly extending portion of the push plunger
35 first end of the handle
36 protrusion of the push plunger
37 upwardly extending portion of the ratchet
39 stub of the ratchet
41 bottom cam face of the slot
42 hole on the guiding plate
43 actuator assembly
44 steps on the guiding plate
45 leg
46 cutting plate
47 cutting teeth
48 slots
49 first end portion of the cutting plate
50 second end portion of the cutting plate
51 spring
52 lug
53 bulges on the cutting plate
54 openings on the frame
55 bump on the linkage
56 protrusion on the cutting plate
57 indicator plate
58 frame
59 third portion of the linkage
60 trough
61 first portion of the trough
62 second portion of the trough
63 rear edge of the slicing plate
64 front edge of the slicing plate

What is claimed is:

1. A mandolin slicer (1) comprising:

a handle (2) having a first end (35) and a second end (13);

a frame (58) extending from the first end (35) of the handle (2) and having two opposite side walls; a guiding plate (5) having a proximal end (6) pivotally connected to the frame (58), and a distal end (7);

a slicing plate (3) held between the two side walls of the frame (58) and configured to comprise a slicing blade (9), wherein the slicing blade (9) and the distal end (7) of the guiding plate (5) together define a gap (8) as slice thickness for an item to be sliced;

a linkage (10) for movably carrying the guiding plate (35) so that the movement of the linkage (10) enables the guiding plate (5) to pivot around its proximal end (6), wherein the guiding plate pivots relative to the slicing blade (9) thereby to provide variable slice thickness for the item to be sliced; and an actuator assembly (43) in operative connection with the linkage (10) to move the linkage (10) to pivot the guiding plate (5) around the proximal end of the guiding plate.

2. The mandolin slicer (1) of claim 1, wherein the linkage (10) is configured to move to a plurality of carrying positions of the guiding plate (5) for carrying the guiding plate (5) so as to create a plurality of predetermined slice thicknesses.

3. The mandolin slicer (1) of claim 2, further comprising a cutting plate (46) arranged under the guiding plate (5), the cutting plate (46) having a first end portion (49) pivotally connected to the frame (58), and a second end portion (50) having a plurality of cutting teeth (47) mounted thereon, wherein when the linkage (10) moves to one of designated one or more of the plurality of carrying positions, the cutting plate (46) is permitted to pivot upwardly around its first end portion (49) towards the guiding plate (5), causing the plurality of cutting teeth (47) to protrude beyond the guiding plate (5) through a plurality of slots (48) formed in the guiding plate (5) in the vicinity of the distal end (7), such that the item to be sliced is subject to a cutting operation implemented by the cutting teeth (47) in combination with the slicing blade (9); and when the linkage (10) moves away from the designated carrying position, the cutting plate (46) pivots downwardly to release the cutting teeth (47) from the guiding plate (5), such that the item to be sliced is subject to a cutting operation implemented by the slicing blade (9) only.

4. The mandolin slicer (1) of claim 3, wherein the actuator assembly (43) is configured as a ballpoint pen ratchet mechanism (12) provided in the handle (2), the ballpoint pen ratchet mechanism (12) is latched in a plurality of latched positions, which are respectively correspondent to the plurality of carrying positions of the linkage (10).

5. The mandolin slicer (1) of claim 4, wherein the ballpoint pen ratchet mechanism (12) comprises: a push plunger (16), and a ratchet (17) connected to a compression spring (18) which is forced to move the ratchet (17) upward, and coupled to the linkage (10), wherein the push plunger (16) and the ratchet (17) comprise cooperating cam faces (19, 20) whereby the ratchet (17) tends to rotate when the cam faces of the push plunger (16) are forced against the cam faces of the ratchet (17), and the rotation of the ratchet (17) results in an axial displacement of the ratchet (17) among the plurality of latched positions, which causes the linkage (10) to move to the plurality of carrying positions.

6. The mandolin slicer (1) of claim 5, wherein the ballpoint pen ratchet mechanism (12) further comprises a sleeve (14) having a plurality of spaced apart axial slots (25) of different lengths formed on an inner wall thereof; and the ratchet (17) comprises an axial rib (24) which is rotated to alternately engage with the respective axial slots (25) of the sleeve (14), thereby allowing the ratchet (17) to reach the respective latched positions.

7. The mandolin slicer (1) of claim 6, wherein the ballpoint pen ratchet mechanism (12) comprises a button (30) fixedly connected to the push plunger (16) and extending beyond the second end (13) of the handle (2).

8. The mandolin slicer (1) of claim 5, wherein the linkage (10) is configured to have a first portion (28) comprising two spaced apart legs (45) which movably carry two opposite sides of the guiding plate (5), a second portion (29) integrally formed with the first portion, and a third portion (59) having one end rotatably coupled to the second portion (29) and the other end fixed to the ratchet (17).

9. The mandolin slicer (1) of claim 8, wherein a pair of lugs (52) extend downwardly from the two sides, respectively, of the guiding plate (5), and a plurality of steps (44) on a bottom surface of each of the lugs (52) are formed in a direction of the movement of the linkage (10) to provide the plurality of carrying positions where the legs of the linkage carry the guiding plate (5).

10. The mandolin slicer (1) of claim 9, wherein a bump (55) is fanned at an end of each of the two legs (45) of the linkage (10), and a protrusion (56) is formed on each of two opposite sides of the cutting plate (46) and positioned to correspond to the designated carrying position, such that the bumps (55) press against the protrusions (56), causing the cutting plate (46) to pivot upwardly with the cutting teeth (47) moving to protrude beyond the guiding plate (5) through the slots (48).

11. The mandolin slicer (1) of claim 10, wherein a pair of springs (51) are provided each having one end fixed to a respective side of the cutting plate (46) to bias the cutting plate (46) to pivot downwardly, such that the cutting teeth (47) are released from the guiding plate (5).

12. The mandolin slicer (1) of claim 10, wherein the cutting plate (46) comprises a guiding trough (60) formed beneath one of the protrusions (56) for receiving a leading portion of the respective leg (45), the guiding trough (60) comprising a first portion (61) having a constant width and a second portion (62) extending from the first portion (61) and having an incrementally increasing width, wherein the width of the first portion (61) is sized to purposely constrain the cutting plate (46) in place when the leading portion of the leg (45) is received therein until the bumps (55) press against the protrusions (56) where the leading portion of the leg (54) moves to the second portion (62), and the increasing width of the second portion (62) is sized to release the constraint of the cutting plate (46) and allow the cutting plate (46) to pivot upwardly.

13. The mandolin slicer (1) of claim 3, wherein the cutting plate (46) is pivotally connected to the frame (58) by a pair of bulges (53) formed on two opposite sides, respectively, of the first end portion (49) of the cutting plate (46) and inserted into a pair of openings (54) formed on the frame (58).

14. The mandolin slicer (1) of claim 2, wherein the handle (2) comprises an indicating window (26); and a plurality of indicators (27) corresponding to the carrying positions are arranged on the linkage (10) and configured in such a manner that each indicator corresponding to a respective one of the carrying positions moves to be exposed through the indicating window (26) with the movement of the linkage (10) to said carrying position.

15. The mandolin slicer (1) of claim 14, wherein an indicator plate (57) is fixed on the linkage (10), and the plurality of indicators (27) are arranged on the indicator plate (57).

16. The mandolin slicer (1) of claim 1, wherein the guiding plate (5) is pivotally connected to the frame (58) by a pair of hinges (31) arranged on the frame (58) and inserted into a pair of holes (42) formed on two opposite sides, respectively, of the proximal end (6) of the guiding plate (5).

17. The mandolin slicer (1) of claim 1, wherein the handle (2) and the frame (58) are formed integrally.

* * * * *